US009889667B2

(12) United States Patent
Hamaguchi et al.

(10) Patent No.: US 9,889,667 B2
(45) Date of Patent: Feb. 13, 2018

(54) MAINTENANCE DEVICE USED IN LIQUID DISCHARGE HEAD, LIQUID DISCHARGE DEVICE, AND LIQUID DISCHARGE APPARATUS

(71) Applicants: Masaya Hamaguchi, Kanagawa (JP); Shunichi Oohara, Kanagawa (JP)

(72) Inventors: Masaya Hamaguchi, Kanagawa (JP); Shunichi Oohara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/430,432

(22) Filed: Feb. 10, 2017

(65) Prior Publication Data

US 2017/0266974 A1 Sep. 21, 2017

(30) Foreign Application Priority Data

Mar. 16, 2016 (JP) ..... 2016-053043
Jul. 22, 2016 (JP) ..... 2016-144397

(51) Int. Cl.
*B41J 2/165* (2006.01)

(52) U.S. Cl.
CPC ..... *B41J 2/16505* (2013.01); *B41J 2/16523* (2013.01)

(58) Field of Classification Search
CPC . B41J 2/16505; B41J 2/16514; B41J 2/16523
See application file for complete search history.

(56) References Cited

U.S. PATENT DOCUMENTS 7,510,265 B2 * 3/2009 Kang ..... B41J 2/16552 347/32
2004/0265520 A1 * 12/2004 Nakajima ..... C09D 11/101 428/34.1
2007/0132807 A1 * 6/2007 Ota ..... B41J 2/16552 347/22
2010/0149252 A1 * 6/2010 Yoshihisa ..... B41J 2/16547 347/32
2011/0242206 A1 * 10/2011 Komatsu ..... B41J 2/16505 347/29

FOREIGN PATENT DOCUMENTS

JP 2006-168093 6/2006
JP 2007-175969 7/2007
JP 2012-096513 5/2012

* cited by examiner

*Primary Examiner* — Henok Legesse
(74) *Attorney, Agent, or Firm* — Cooper & Dunham LLP

(57) ABSTRACT

A maintenance device used in a liquid discharge head includes a first cap to seal a nozzle face of the liquid discharge head, a second cap disposed outside the first cap, and a humidity conditioner disposed outside the first cap and inside the second cap. The second cap seals the first cap and at least a contact portion between the nozzle face of the liquid discharge head and the first cap. The humidity conditioner adjusts humidity in a space between the first cap and the second cap.

12 Claims, 35 Drawing Sheets

| | RELATIVE HUMIDITY (%RH) | | | |
|---|---|---|---|---|
| SALT TYPE | 10°C | 20°C | 30°C | 40°C |
| POTASSIUM SULFATE | 98.2 ± 0.8 | 97.6 ± 0.6 | 97.0 ± 0.4 | 96.4 ± 0.4 |
| POTASSIUM CHLORIDE | 86.8 ± 0.4 | 85.1 ± 0.3 | 83.6 ± 0.3 | 82.3 ± 0.3 |
| SODIUM CHLORIDE | 75.7 ± 0.3 | 75.5 ± 0.2 | 75.1 ± 0.2 | 74.7 ± 0.2 |
| SODIUM BROMIDE | 62.2 ± 0.6 | 59.1 ± 0.5 | 56.0 ± 0.4 | 53.2 ± 0.5 |
| POTASSIUM CARBONATE | 43.1 ± 0.4 | 43.2 ± 0.4 | 43.2 ± 0.5 | – |

MAINTENANCE DEVICE USED IN LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2016-053043 filed, on Mar. 16, 2016, and 2016-144397 filed, on Jul. 22, 2016, in the Japan Patent Office, the entire disclosure of each of which is hereby incorporated by reference herein.

BACKGROUND

Technical Field

Embodiments of the present disclosure relate to a maintenance device used in a liquid discharge head, a liquid discharge device, and a liquid discharge apparatus.

Description of the Related Art

Currently, image forming apparatuses used to output information in the form of electronic data or copy documents are widely used. Inkjet printers, one type of image forming apparatuses, discharge ink from a nozzle of a liquid discharge head onto recording media to perform printing.

In such inkjet printers, if ink droplets are not discharged from the nozzle for a while, solvent of ink inside the nozzle evaporates, and the ink in the nozzle dries. Then, the viscosity of ink increases, or the meniscus of ink inside the nozzle may be broken. As a result, the nozzle may be clogged, or bubbles may enter the nozzle, and desirable printing is inhibited.

To prevent such inconveniences, for example, a nozzle face is capped to keep the nozzle face and the adjacent area at a constant vapor pressure, thereby inhibiting the ink from drying or the meniscus from being broken.

Additionally, after ink is discharged, scattering ink may adhere to the liquid discharge head or the nozzle face. If the adhering ink is left as it is, the ink dries to solidify. As the dried ink accumulates, solidified ink may hang from the liquid discharge head or the nozzle face, or the nozzle face may become dirty.

If inkjet printers perform printing in such a state, the hanging ink may contact the recording medium or a conveyor such as a conveyance roller, causing defective printing, or the ink solidified on the nozzle faces may hinder discharge of ink droplets.

Accordingly, there are inkjet printers that remove ink adhering to the liquid discharge head or the nozzle face as maintenance.

SUMMARY

An embodiment of this disclosure provides a maintenance device used in a liquid discharge head includes a first cap to seal a nozzle face of the liquid discharge head, a second cap disposed outside the first cap, and a humidity conditioner disposed outside the first cap and inside the second cap. The second cap seals the first cap and at least a contact portion between the nozzle face of the liquid discharge head and the first cap. The humidity conditioner adjusts humidity in a space between the first cap and the second cap.

In another embodiment, a liquid discharge device includes a liquid discharge head and the above-described maintenance device, to perform maintenance of the liquid discharge head.

In yet another embodiment, a liquid discharge apparatus includes a liquid discharge head; and the above-described maintenance device, to perform maintenance of the liquid discharge head.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
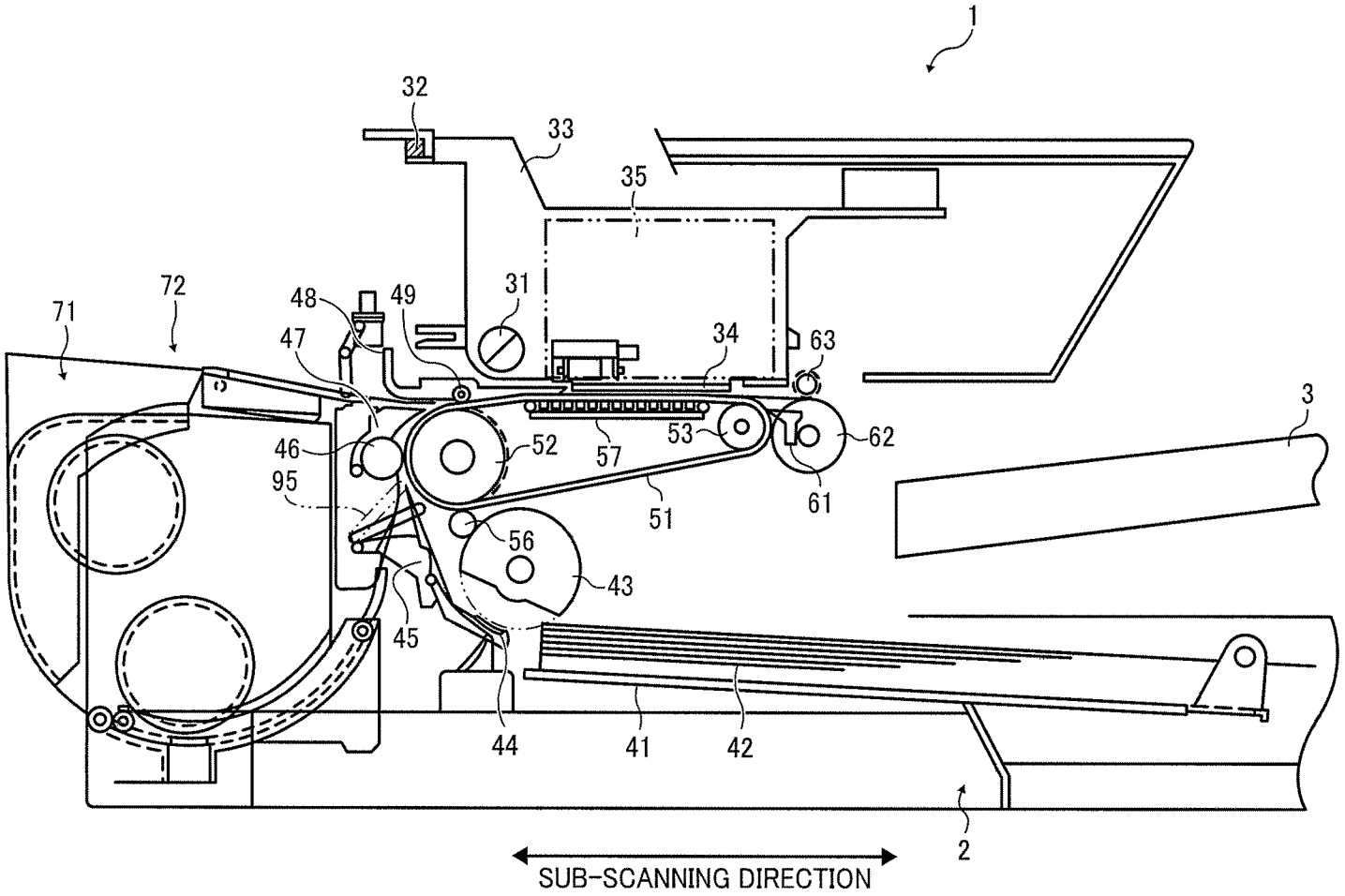
FIG. 1 is a schematic side view of an inkjet printer according to an embodiment.

The accompanying drawings are intended to depict embodiments of the present invention and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, descriptions are given below of an inkjet printer including a carriage and a liquid discharge head mounted on the carriage, according to an embodiment of the present invention. As used herein, the singular forms "a", "an", and "the" are intended to include the plural forms as well, unless the context clearly indicates otherwise.

It is to be noted that the suffixes y, m, c, and k attached to each reference numeral indicate only that components indicated thereby are used for forming yellow, magenta, cyan, and black images, respectively, and hereinafter may be omitted when color discrimination is not necessary.

The inkjet printer serves as a liquid discharge apparatus including a liquid discharge head or a liquid discharge device. The liquid discharge apparatus is configured to drive the liquid discharge head to discharge liquid. The term "liquid discharge apparatus" used here includes, in addition to apparatuses to discharge liquid to materials to which the liquid can adhere, apparatuses to discharge liquid into gas (air) or liquid.

The term "liquid discharge head" in this disclosure means a single function unit to discharge liquid and corresponds to a liquid discharge head 34 in the present embodiment. Examples of source to generate energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes. The terms "image formation", "recording", "printing", "image printing", and "molding" used in the present disclosure are synonymous with each other.

The term "liquid discharge device" means a structure including the liquid discharge head and a functional part(s) or mechanism integrated or united thereto. That is, "liquid discharge device" is an assembly of parts relating to liquid discharge. For example, "liquid discharge device (or unit)" includes a combination of the liquid discharge head and at least one of a head tank, the carriage, a supply unit, a maintenance device (or a maintenance unit), and a main-scan moving mechanism.

Herein, the terms "integrated" or "united" mean attaching the liquid discharge head and the functional parts (or mechanism) to each other by fastening, screwing, binding, or engaging and holding one of the liquid discharge head and the functional parts movably relative to the other. The liquid discharge head may be detachably attached to the functional part(s) or unit(s) s each other.

For example, "liquid discharge unit" includes the liquid discharge head and the head tank united to each other. Alternatively, the liquid discharge head and the head tank are coupled to each other via, e.g., a tube. Here, a unit including a filter may be added between the head tank and the liquid discharge head in the liquid discharge device. In yet another example, the liquid discharge head and the carriage may be united as "liquid discharge device".

In still another example, in the liquid discharge device, the liquid discharge head is movably held by a guide that is a portion of a main-scan moving mechanism, so that the liquid discharge head and the main-scan moving mechanism are united together. The liquid discharge device may be an integrated unit in which the liquid discharge head, the carriage, and the main-scan moving mechanism are united into a single unit.

In another example, the cap that is a portion of the maintenance device is secured to the carriage mounting the liquid discharge head so that the liquid discharge head, the carriage, and the maintenance device are integrated or united into the liquid discharge device.

Further, in another example, a tube is coupled to the liquid discharge head to which either the head tank or a channel member is attached, so that the liquid discharge head and the supply unit are united into a single unit.

The main-scan moving mechanism may be a guide only. The supply unit may be a tube(s) only or a loading portion only.

The liquid discharge apparatus may include at least one of devices to feed, convey, and eject the material to which liquid can adhere. The liquid discharge apparatus may further include at least one of a pretreatment apparatus and a post-treatment apparatus.

As the liquid discharge apparatuses, for example, there are image forming apparatuses to discharge ink onto sheets to form images and three-dimensional apparatuses to discharge molding liquid to a powder layer in which powder is molded into a layer-like shape, so as to form three-dimensional articles.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-mentioned term "material to which liquid can adhere" represents a material to which liquid is at least temporarily adhere, a material to which liquid adhere to solidify thereon, or a material into which liquid permeates. Examples of "material to which liquid can adhere" include paper sheets, recording media such as recording paper, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

Examples of materials to which liquid can adhere include any material to which liquid can adhere even temporarily, such as paper, thread, fiber, fabric, leather, metal, plastic, glass, wood, and ceramic.

The term "liquid" is not limited to a particular liquid as long as the liquid has a viscosity or surface tension to be discharged from the liquid discharge head. However, preferably, the viscosity of the liquid is not greater than 30 mPa·s under ordinary temperature and ordinary pressure, or heated or cooled to 30 mPa·s or lower than 30 mPa·s. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Although the liquid discharge apparatus is generally an apparatus in which the liquid discharge head and a material to which liquid can adhere move relative to each other, the liquid discharge apparatus is not limited thereto. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the sheet with the treatment liquid to reform the sheet surface and an injection granulation apparatus to eject a composition liquid including a raw material dispersed in a solution from a nozzle to mold particles of the raw material.

The inkjet printer according to the present embodiment discharges ink droplets from a nozzle formed in a liquid discharge head while moving a carriage in a main scanning direction relative to a recording medium, thereby forming an image portion corresponding to one or multiple lines with a single stroke of the carriage in the main scanning direction. Then, the inkjet printer according to the present embodiment forms another image portion on the subsequent line in a sub-scanning direction on the recording medium and repeats this operation to perform printing.

Figure 2:
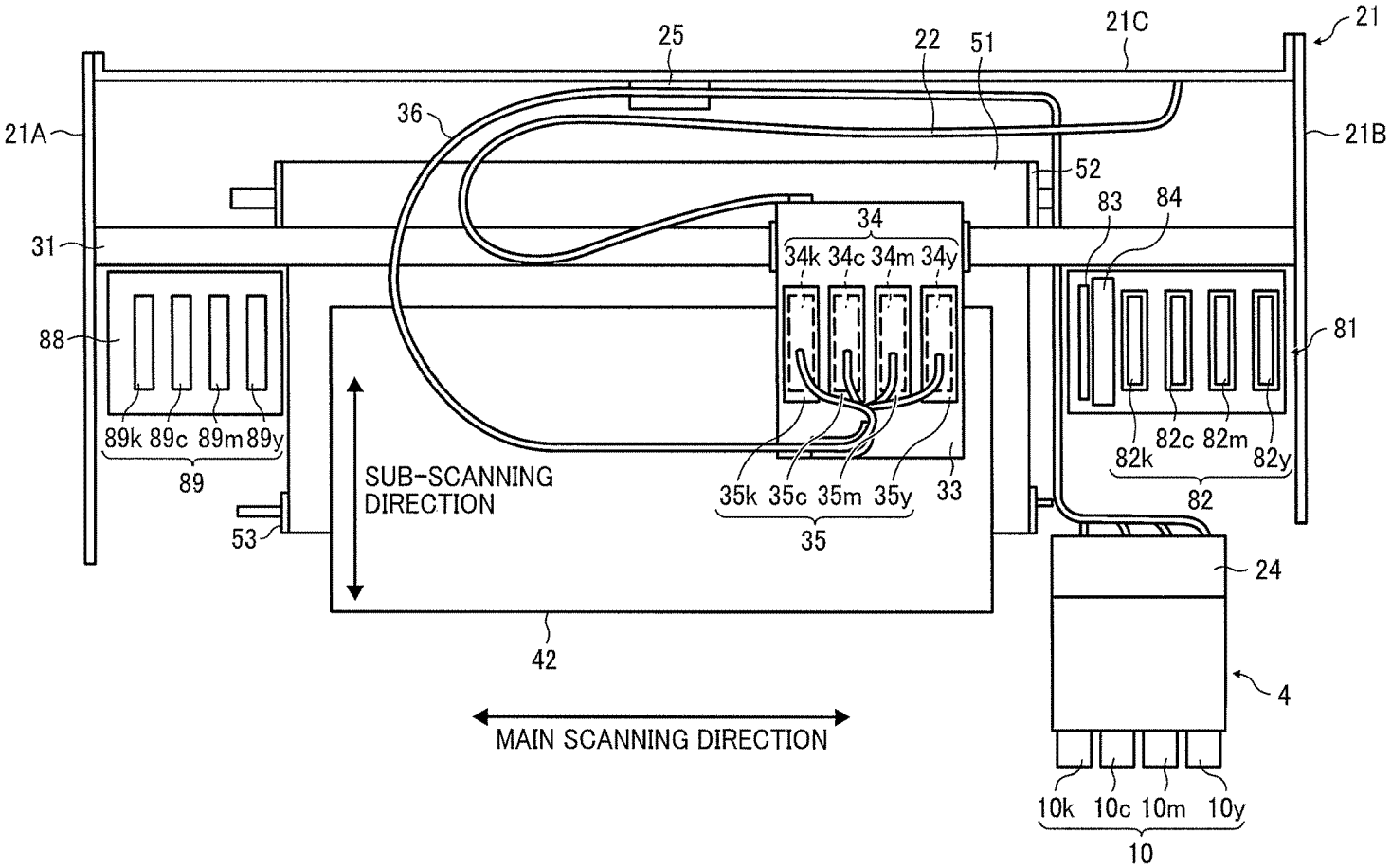
FIG. 2 is a penetrative view, from above, of the inkjet printer illustrated in FIG. 1.

Referring to FIGS. 1 and 2, descriptions are given below of an internal structure and mechanism of an inkjet printer 1 according to the present embodiment. In the accompanying drawings, a front side of the inkjet printer 1 is the side on which an output tray 3 is disposed. FIG. 1 is an internal view of the inkjet printer 1 as viewed in the main scanning direction.

As illustrated in FIG. 1, the inkjet printer 1 according to the present embodiment includes a sheet feeding tray 2, the output tray 3, a carriage support rod 31, a stay 32, a carriage 33, a sheet table 41 on which a sheet 42 is mounted, a sheet feeding roller 43, a separation pad 44, a guide 45, a counter roller 46, a conveyance guide 47, a pressing member 48, an end pressing roller 49, a conveyor belt 51, a conveyance roller 52, a tension roller 53, a charging roller 56, a recording guide 57, a stripping claw 61, an ejection roller 62, an ejection roller 63, a sheet reversing unit 71, a bypass feeding tray 72 (a manual sheet feeding tray), and a sheet sensor 95.

As illustrated in FIG. 2, the inkjet printer 1 further includes a cartridge mount 4, ink cartridges 10*k*, 10*c*, 10*m*, and 10*y* (collectively "ink cartridges 10"), a frame 21, a wire harness 22, a supply pump unit 24, a latch 25, an ink supply tube 36, a maintenance device 81 for standby time, serving as a maintenance device (i.e., a maintenance-and-recovery unit) for the liquid discharge head, a maintenance device 88 for recording time, and the sheet sensor 95.

The frame 21 includes a left frame 21A, a right frame 21B, and a back frame 21C. The maintenance device 81 for standby time includes nozzle caps 82 (first caps), a wiper blade 83, and a dummy discharge receptacle 84. The maintenance device 88 for recording time includes dummy discharge receptacles 89*k*, 89*c*, 89*m*, and 89*y* (collectively "dummy discharge receptacles 89"). The carriage 33 includes the liquid discharge head 34 and a sub tank including sub tanks 35*k*, 35*c*, 35*m*, and 35*y*.

The nozzle caps 82 include nozzle caps 82*k*, 82*c*, 82*m*, and 82*y*. As illustrated in FIG. 2, the nozzle caps 82 serving as the first caps correspond to a plurality of ink cartridges 10, respectively. That is, the inkjet printer 1 includes a plurality of nozzle caps 82.

Regarding the internal structure and mechanism of the inkjet printer 1, descriptions about recording on sheets and descriptions about sheet conveyance are separately given below with reference to FIGS. 1 and 2.

Initially, descriptions are given of operation of the inkjet printer 1 for recording on sheets. The ink cartridge 10*y* for yellow, the ink cartridge 10*c* for cyan, the ink cartridge 10*m* for magenta, and the ink cartridge 10*k* for black are mounted in the cartridge mount 4 for supply of ink of each color.

The carriage support rod 31 is a guide member laterally bridging the left frame 21A and the right frame 21B. The carriage support rod 31 supports the carriage 33 slidably in the main scanning direction illustrated in FIG. 2. The carriage 33 is supported slidably in the main scanning direction illustrated in FIG. 2 by the carriage support rod 31 and the stay 32 and is driven by a main scanning motor 500 via a main scanning belt. On the carriage 33, the liquid discharge head 34 including liquid discharge heads 34*y*, 34*c*, 34*m*, and 34*k* to discharge ink droplets of yellow (Y), cyan (C), magenta (M), and black (K) is mounted.

Each of the four liquid discharge heads 34*y*, 34*c*, 34*m*, and 34*k* is oriented perpendicular to the main scanning direction of the carriage 33 illustrated in FIG. 2. The four liquid discharge heads 34*y*, 34*c*, 34*m*, and 34*k* are lined parallel to the main scanning direction illustrated in FIG. 2 and oriented to eject ink droplets downward.

The carriage 33 includes the sub tank 35 to supply the liquid discharge heads 34*y*, 34*c*, 34*m*, and 34*k* of the liquid discharge head 34 with the respective color inks. The sub tank 35 includes the sub tanks 35*k*, 35*c*, 35*m*, and 35*y* corresponding to the respective colors of the liquid discharge heads 34*y*, 34*c*, 34*m*, and 34*k*.

To each of the sub tanks 35*k*, 35*c*, 35*m*, and 35*y*, the ink is supplied from the ink cartridge 10 of the corresponding color, mounted in the cartridge mount 4, through the ink supply tube 36. The cartridge mount 4 is provided with the supply pump unit 24 to supply the ink from the ink cartridge 10 through the ink supply tube 36 to the sub tank 35. The ink supply tube 36 is held, at a position midway in a route of laying inside the inkjet printer 1, by the latch 25 secured to the back frame 21C.

The maintenance device 81 maintains or recovers conditions of the nozzles of the liquid discharge heads 34*y*, 34*c*, 34*m*, and 34*k* in idle time or standby time (non-recording time). In the present embodiment, the maintenance device 81 is disposed in a non-print area on the side of the right frame 21B as illustrated in FIG. 2.

The maintenance device 81 includes the nozzle caps 82 (82*k*, 82*c*, 82*m*, and 82*y*) to cap the nozzle faces of the liquid discharge heads 34*y*, 34*c*, 34*m*, and 34*k*, respectively, the wiper blade 83 that is a blade to wipe the nozzle faces, and the dummy discharge receptacle 84 onto which excessive recording liquid that has thickened is discharged. Each nozzle cap 82 caps space adjacent to the nozzle face, which is hereinafter referred to as a nozzle cap interior 106 (illustrated in FIG. 4) to seal the nozzle cap interior 106 in order to keep the nozzle cap interior 106 at a constant atmosphere or almost constant atmosphere.

The nozzle caps 82*k*, 82*c*, 82*m*, and 82*y* correspond to the liquid discharge heads 34*y*, 34*c*, 34*m*, and 34*k*, respectively, and are lined in the same direction as the arrangement direction of the liquid discharge heads 34*y*, 34*c*, 34*m*, and 34*k*, at widths identical or similar to the widths of the liquid discharge heads 34*y*, 34*c*, 34*m*, and 34*k*.

The maintenance device 81 further includes suction tubes 85 (illustrated in FIG. 4) for the four colors and a moisturizing and absorbing agent 86 (illustrated in FIG. 4) for each color. The suction tubes 85 are used to suck in the thickened recording liquid and air bubbles from inside the nozzles in a state in which each nozzle face of the liquid discharge head 34 is covered with the nozzle cap 82. The moisturizing and absorbing agent 86 moisturizes the ink inside the nozzles and absorb excessive ink from the nozzles.

The waste recording liquid generated by maintenance operation by the maintenance device 81, the ink discharged into the nozzle caps 82, and the ink discharged into the dummy discharge receptacle 84 are collected in a waste liquid container. The ink adhering to the wiper blade 83 is cleaned by a wiper cleaner (e.g., a wiper scraper 97) and is discharged to the waste liquid container.

With this structure, in the inkjet printer 1 according to the present embodiment, suction and moisturizing of the nozzles of the liquid discharge head 34 are performed during standby time or idle time, thereby inhibiting defective ink discharge caused by the dried ink and bubbles inside the liquid discharge heads 34*y*, 34*c*, 34*m*, and 34*k*. Thus, ink discharging performance can be kept reliable.

The maintenance device 88 maintains or recovers conditions of the nozzles of the liquid discharge heads 34*y*, 34*c*, 34*m*, and 34*k* at the start of recording or during recording. In the present embodiment, the maintenance device 88 is disposed in a non-print area on the side of the left frame 21A as illustrated in FIG. 2. The maintenance device 88 includes the dummy discharge receptacles 89 onto which thickened excessive ink is discharged.

Figure 3:
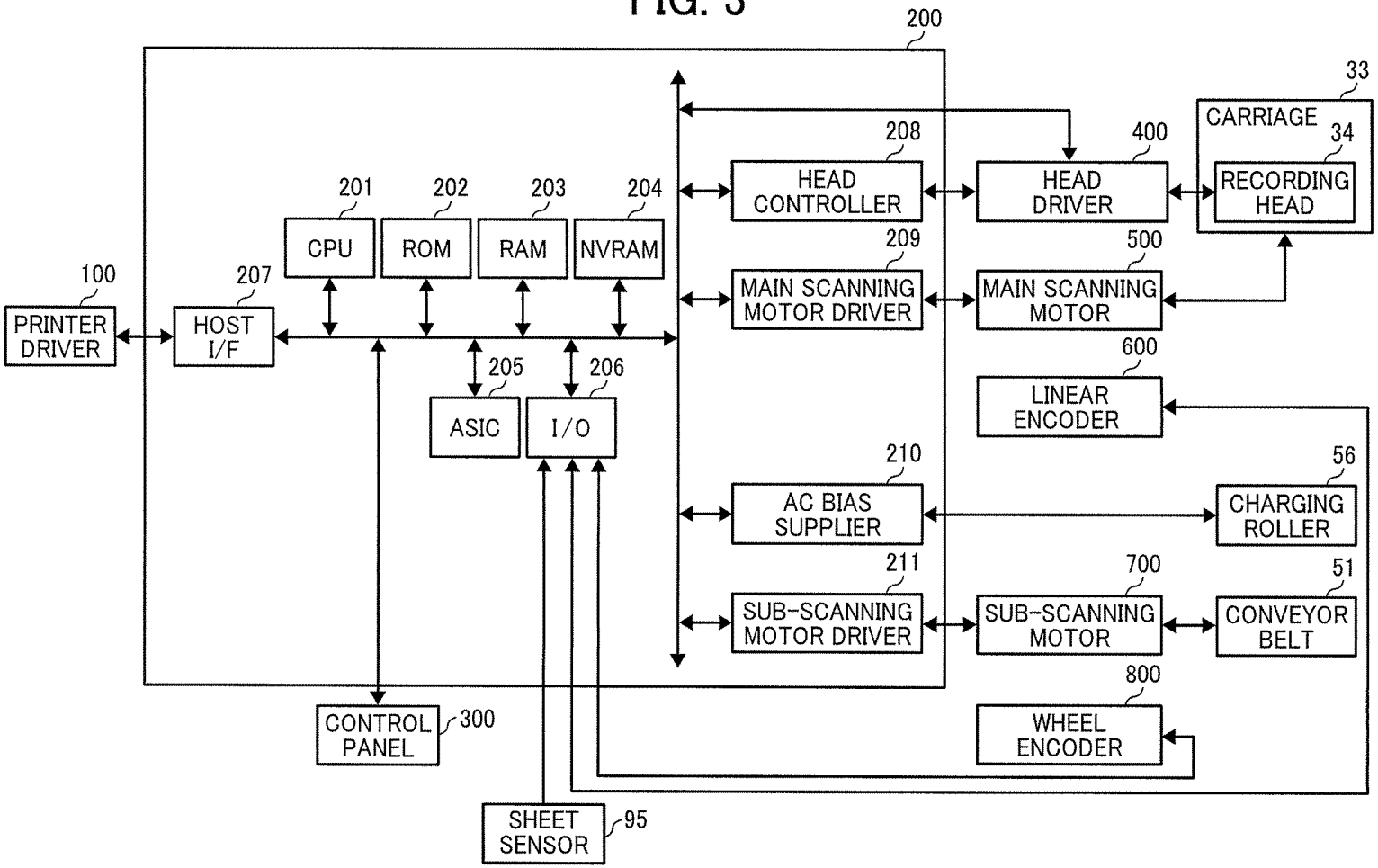
FIG. 3 is a schematic block diagram of a hardware configuration and a functional configuration of an inkjet printer according to an embodiment.

Next, referring to FIG. 3, descriptions are given below of a hardware configuration and a functional configuration of the inkjet printer 1 according to the present embodiment. FIG. 3 is a schematic block diagram of the hardware configuration and the functional configuration of the inkjet printer 1 according to the present embodiment. It is to be noted that, in FIG. 3, solid liens represent electrical connections. Further, elements identical or corresponding to those illustrated in FIG. 1 or 2 are given identical or similar reference characters, and descriptions thereof are omitted.

As illustrated in FIG. 3, the inkjet printer 1 according to the present embodiment includes the carriage 33, the conveyor belt 51, the charging roller 56, a printer driver 100, a controller 200, a control panel 300, a head driver 400, the main scanning motor 500, a linear encoder 600, a sub-scanning motor 700, and a wheel encoder 800.

The printer driver 100 generates print data in a data processing terminal such as a personal computer (PC), an image reading device such as an image scanner, and a host device such as an imager (e.g., a digital camera).

The controller 200 includes a central processing unit (CPU) 201, a read only memory (ROM) 202, a random access memory (RAM) 203, a nonvolatile RAM (NVRAM) 204, an application specific integrated circuit (ASIC) 205, an input/output (I/O) 206, a host interface (I/F) 207, a head controller 208, a main scanning motor driver 209, an alternating-current (AC) bias supplier 210, and a sub-scanning motor driver 211.

The CPU 201 is a computation device and controls actions of the entire inkjet printer 1. That is, the CPU 201 controls operations relating to sheet conveyance and movement of the liquid discharge head 34. The ROM 202 is a non-volatile memory dedicated to reading out and stores programs such as firmware. The RAM 203 is a volatile memory capable of high-speed data reading and writing. The RAM 203 is used as workspace when the CPU 201 processes data. The NVRAM 204 is a non-volatile storage medium capable of data reading and writing, and an operating system (OS), various types of control programs, application programs, and the like are stored therein.

In the above-described hardware configuration, the CPU 201 executes computation according to programs loaded in the RAM 203 from the ROM 202, the NVRAM 204, or recording media such as an optical disc. Then, control software is implemented. With the implemented control software and the above-described hardware in combination, a function block to execute the capabilities of the inkjet printer 1 is constructed.

The ASIC 205 incorporates various types of interfaces to control the entire inkjet printer 1, an image processing circuit, and a circuit to control input and output of image data. The ASIC 205 is controlled by the CPU 201. That is, the ASIC 205 performs processing of various types of signals relating to image data, image processing including sorting of image data, and processing of input signals to control the entire inkjet printer 1.

The I/O 206 inputs, to the controller 200, detection pulses from the linear encoder 600 and the wheel encoder 800 and detection signals from the sheet sensor 95 and other sensors. The host I/F 207 transmits and receives data to and from the host device via the network or a universal serial bus (USB) cable. The linear encoder 600 detects the position of the carriage 33 in the main scanning direction, and the wheel encoder 800 detects the position of the conveyor belt 51 in the sub-scanning direction.

The head controller 208 generates a drive waveform to drive the liquid discharge heads 34*y*, 34*c*, 34*m*, and 34*k* and outputs, to the head driver 400, the image data to selectively drive a pressure generator for the liquid discharge head 34 and various types of data relating thereto. The main scanning motor driver 209 drives the main scanning motor 500. The AC bias supplier 210 supplies an AC bias to the charging roller 56. The sub-scanning motor driver 211 drives the sub-scanning motor 700.

The control panel 300 is a visual user interface for users to check a status of the inkjet printer 1. The control panel 300 serves as both of an output interface to visually display the state of the inkjet printer 1 and an input interface such as a touch panel for users to directly operate the inkjet printer 1 or input data into the inkjet printer 1. That is, the control panel 300 has a capability to display images to accept user operation.

Based on image data (dot pattern data) serially input for one line recorded by the liquid discharge head 34, the head driver 400 selects a driving voltage corresponding to the drive waveform given by a drive waveform generator of the head controller 208 (including a single drive pulse or a plurality of drive pulses). Then, the head driver 400 applies the selected driving voltage to the pressure generators for the liquid discharge heads 34*y*, 34*c*, 34*m*, and 34*k* to drive the liquid discharge heads 34*y*, 34*c*, 34*m*, and 34*k*.

The main scanning motor 500 moves the carriage 33 along the carriage support rod 31 via the main scanning belt, according to signals from the main scanning motor driver 209. The sub-scanning motor 700 drives the conveyance roller 52 via a sub-scanning belt according to signals from the sub-scanning motor driver 211, thereby rotating the conveyor belt 51 in the sub-scanning direction (the belt conveyance direction) illustrated in FIG. 2.

With this configuration, in the inkjet printer 1 according to the present embodiment, the CPU 201 reads and analyzes print data received in a reception buffer of the host I/F 207. Then, the ASIC 205 performs necessary image processing, data rearrangement, and the like and transfers the processed image data to the head controller 208. The head controller 208 outputs the image data and the drive waveform to the head driver 400 at a predetermined timing.

In the inkjet printer 1 described above, as the ink is discharged, scattering ink may adhere to the nozzle face or the liquid discharge head 34. If the adhering ink is left as it is, the ink dries to solidify. As the dried ink accumulates, solidified ink may hang from the liquid discharge head 34 or the nozzle face, or the nozzle face may become dirty.

If inkjet printers perform printing in such a state, the hanging ink may contact the recording medium or a conveyor such as a conveyance roller, causing defective printing, or the ink solidified on the nozzle face may hinder discharge of ink droplets.

Accordingly, in the inkjet printer 1 according to the present embodiment, the adhering ink is wiped off from the liquid discharge head 34 and the nozzle face.

Descriptions are given below of wiping of the nozzle face of the liquid discharge head 34 in the inkjet printer 1 according to the present embodiment, with reference to FIGS. 4 through 13. FIGS. 4 through 13 are cross-sectional views of the inkjet printer 1 according to the present embodiment, as viewed in the sub-scanning direction.

As illustrated in FIGS. 4 through 13, the liquid discharge head 34 according to the present embodiment further includes a nozzle plate 37 and nozzle covers 38. Additionally, as illustrated in FIGS. 4 through 12, the inkjet printer 1 according to the present embodiment includes, as the maintenance device 81, the wiper blade 83, a cleaner roller 87, the wiper scraper 97, and a passage 98 leading to a waste liquid container, at least a portion of which serves as a liquid remover.

The nozzle plate 37 includes a nozzle face 37N in which the nozzle is formed. The nozzle cover 38 covers and protects the nozzle plate 37. The cleaner roller 87 presses the wiper blade 83 against the wiper scraper 97. The wiper scraper 97 scrapes off ink 39 adhering to the wiper blade 83. The ink scraped by the wiper scraper 97 is transported through the passage 98 and collected in the waste liquid container.

It is to be noted that the nozzle caps 82, the wiper blade 83, the suction tubes 85, and the cleaner roller 87 are driven by an identical driver and are configured to operate at respective timings in conjunction with each other.

Figure 4:
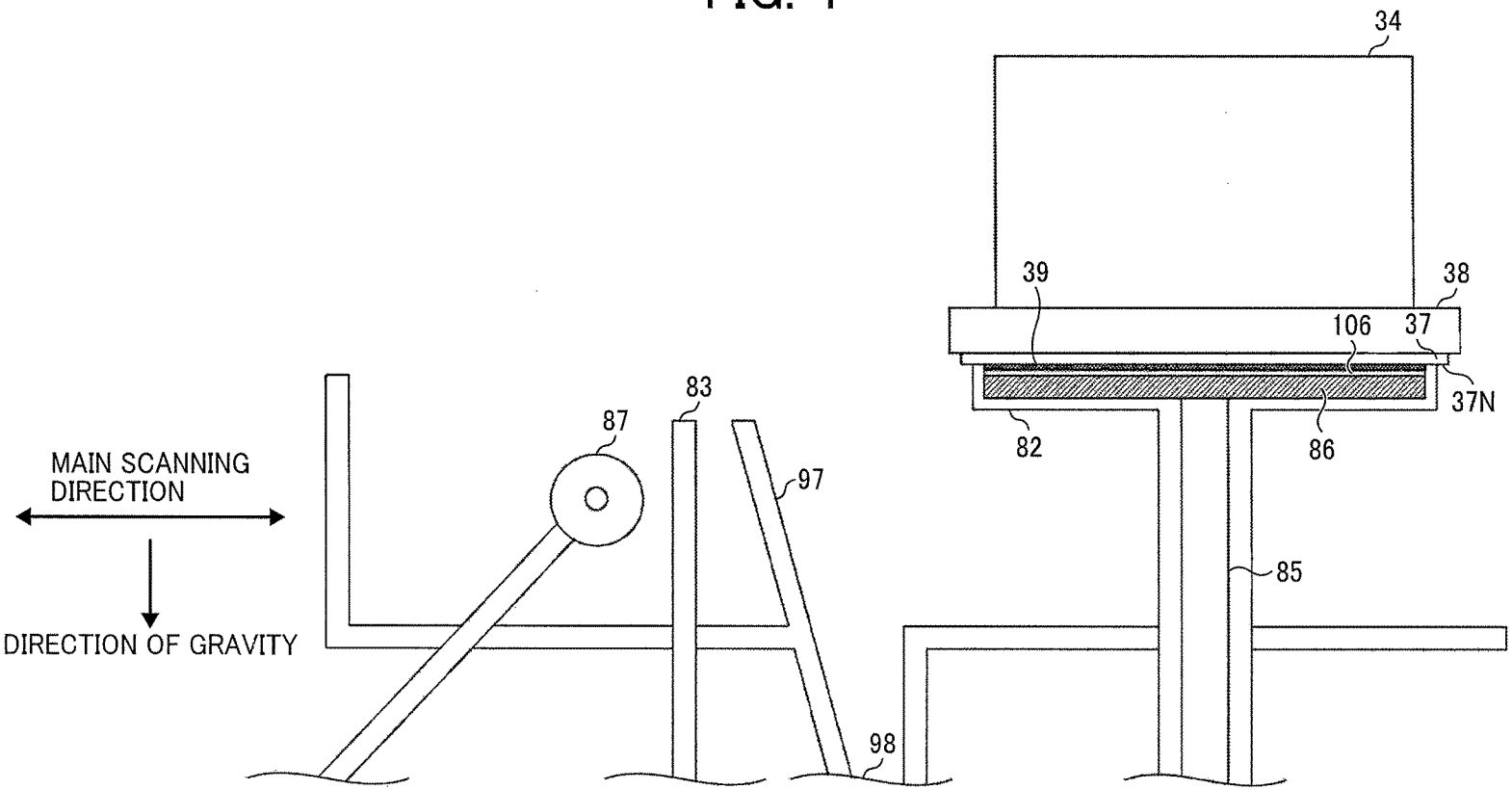
FIG. 4 is a cross-sectional view of the inkjet printer illustrated in FIG. 1, as viewed in the sub-scanning direction.

Before the inkjet printer 1 starts wiping of the nozzle face 37N of the liquid discharge head 34, as illustrated in FIG. 4, the nozzle face 37N of the nozzle plate 37 is capped with the nozzle caps 82.

Figure 5:
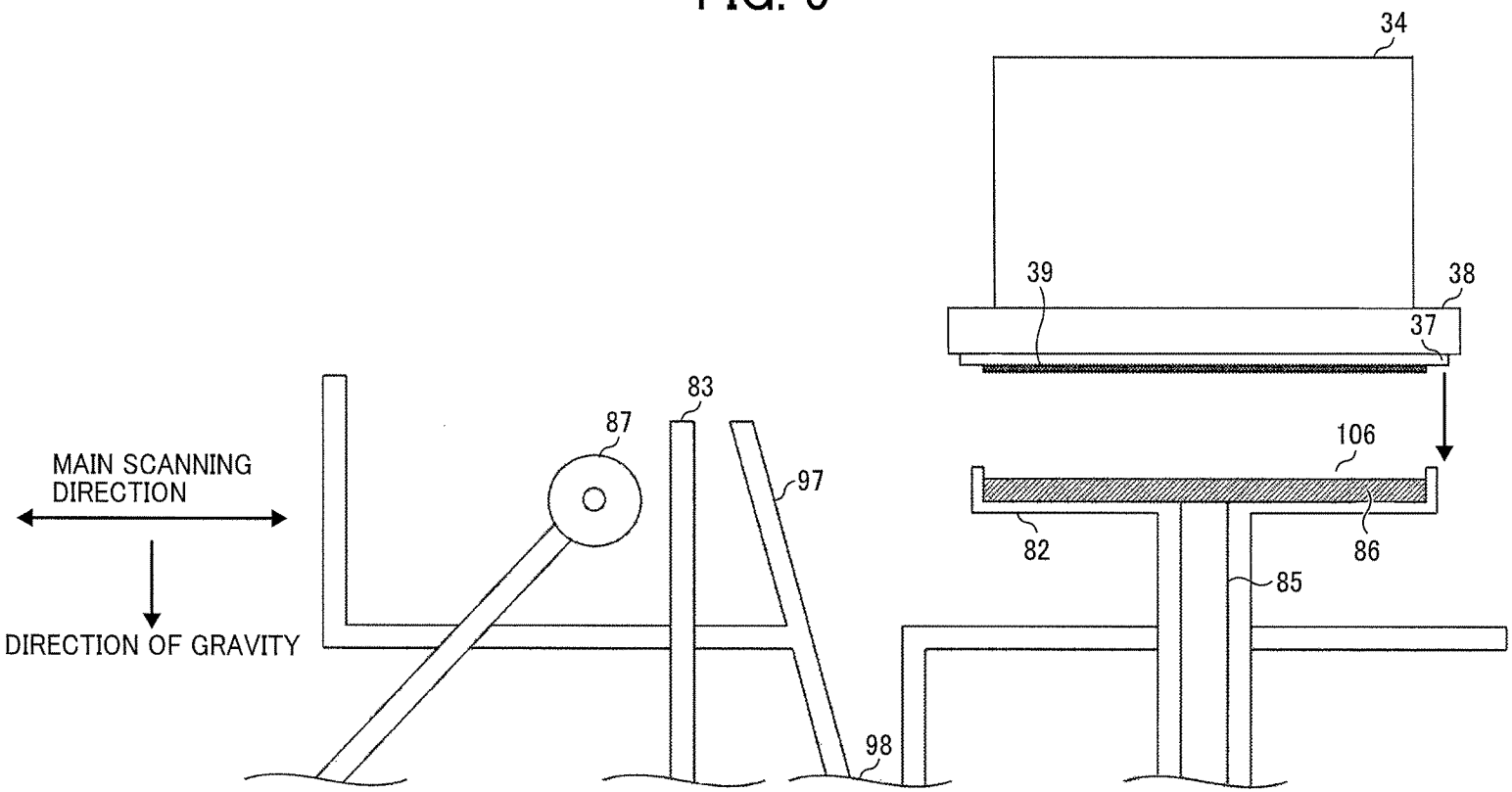
FIG. 5 is a cross-sectional view of the inkjet printer illustrated in FIG. 1, as viewed in the sub-scanning direction.
Figure 6:
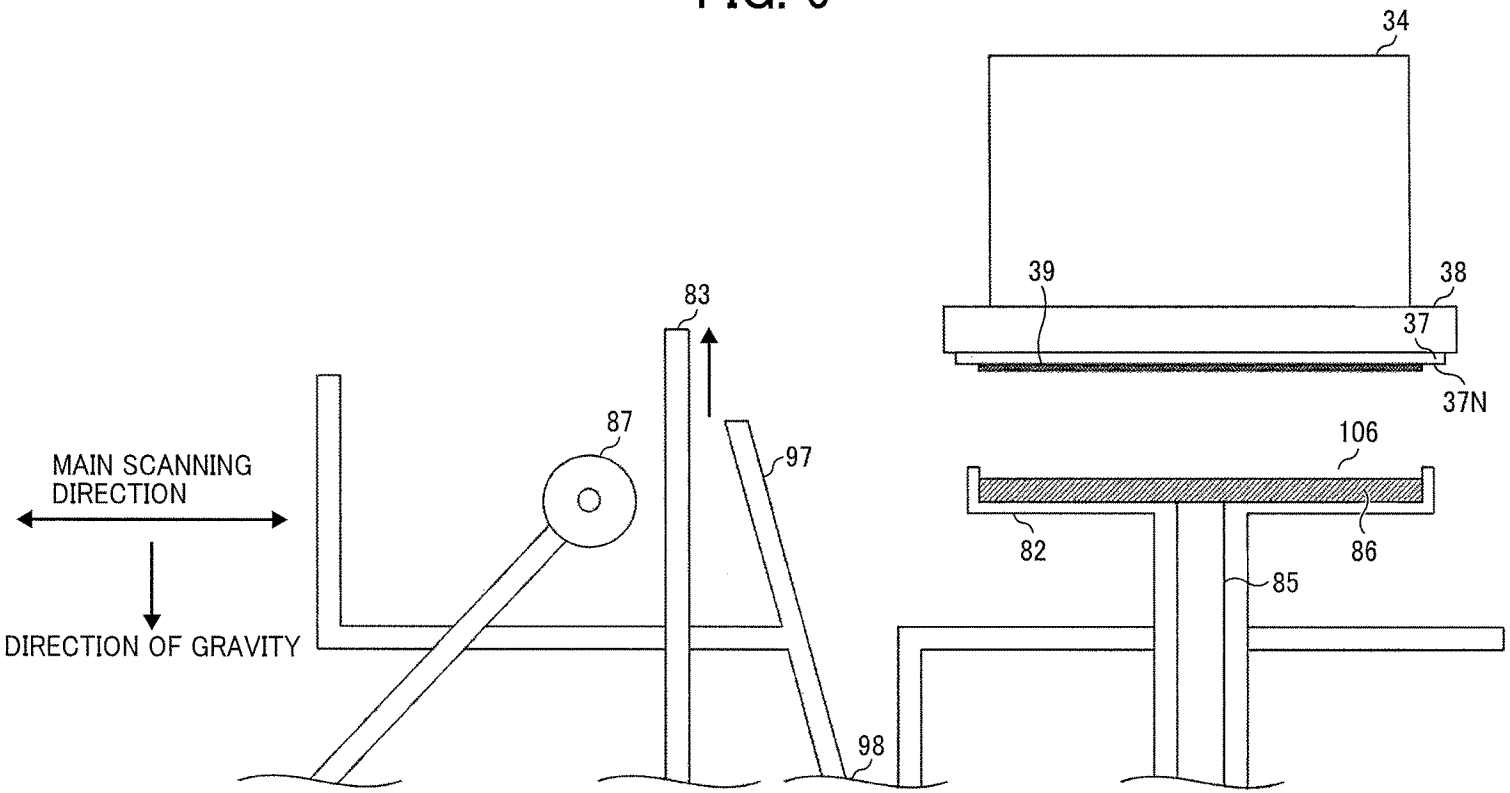
FIG. 6 is a cross-sectional view of the inkjet printer illustrated in FIG. 1, as viewed in the sub-scanning direction.

To perform the wiping of the liquid discharge head 34, the inkjet printer 1 initially lowers the nozzle cap 82 in the direction of gravity as illustrated in FIG. 5 and lifts the wiper blade 83 in the direction of gravity as illustrated in FIG. 6.

Figure 7:
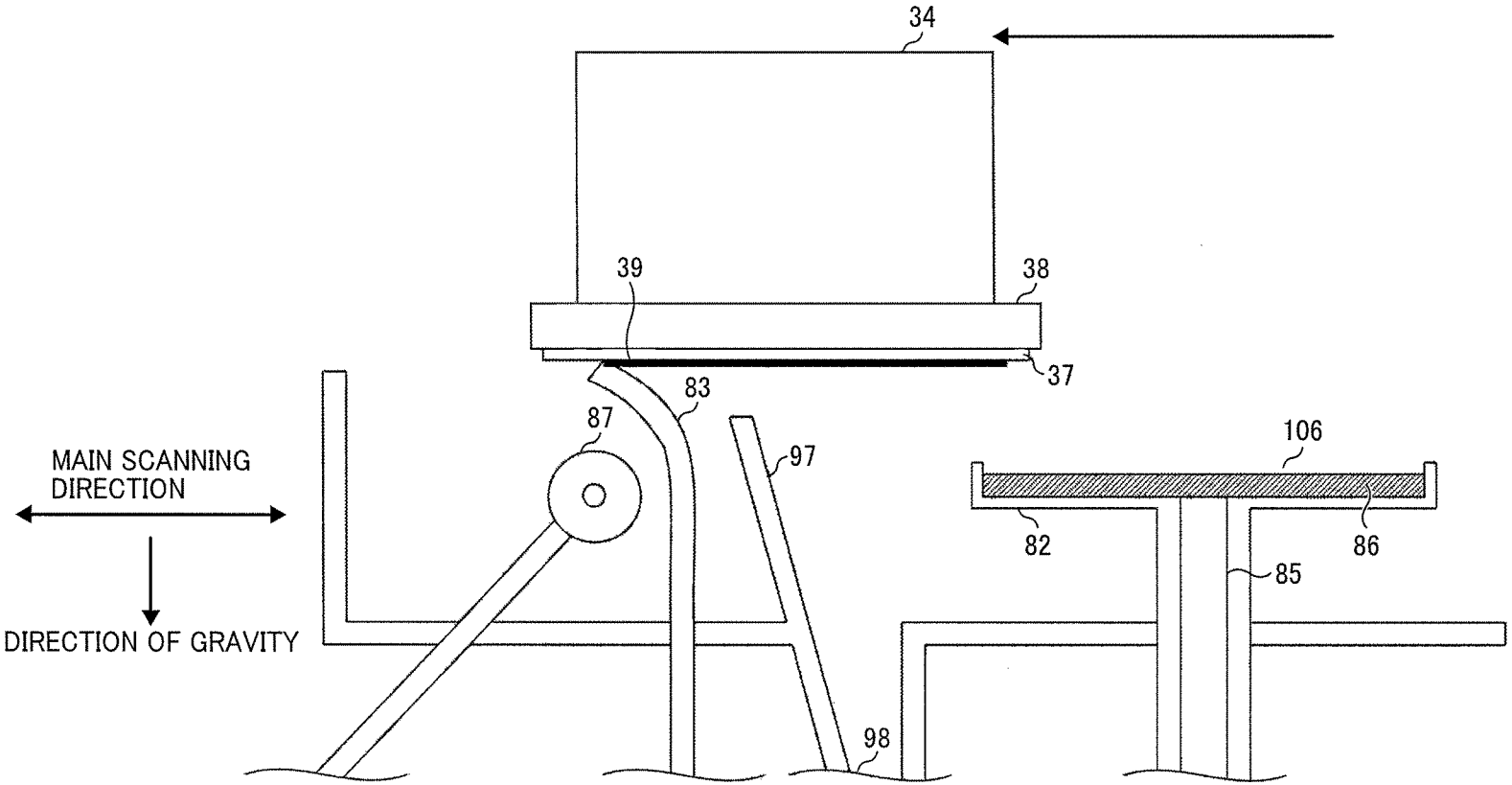
FIG. 7 is a cross-sectional view of the inkjet printer illustrated in FIG. 1, as viewed in the sub-scanning direction.
Figure 8:
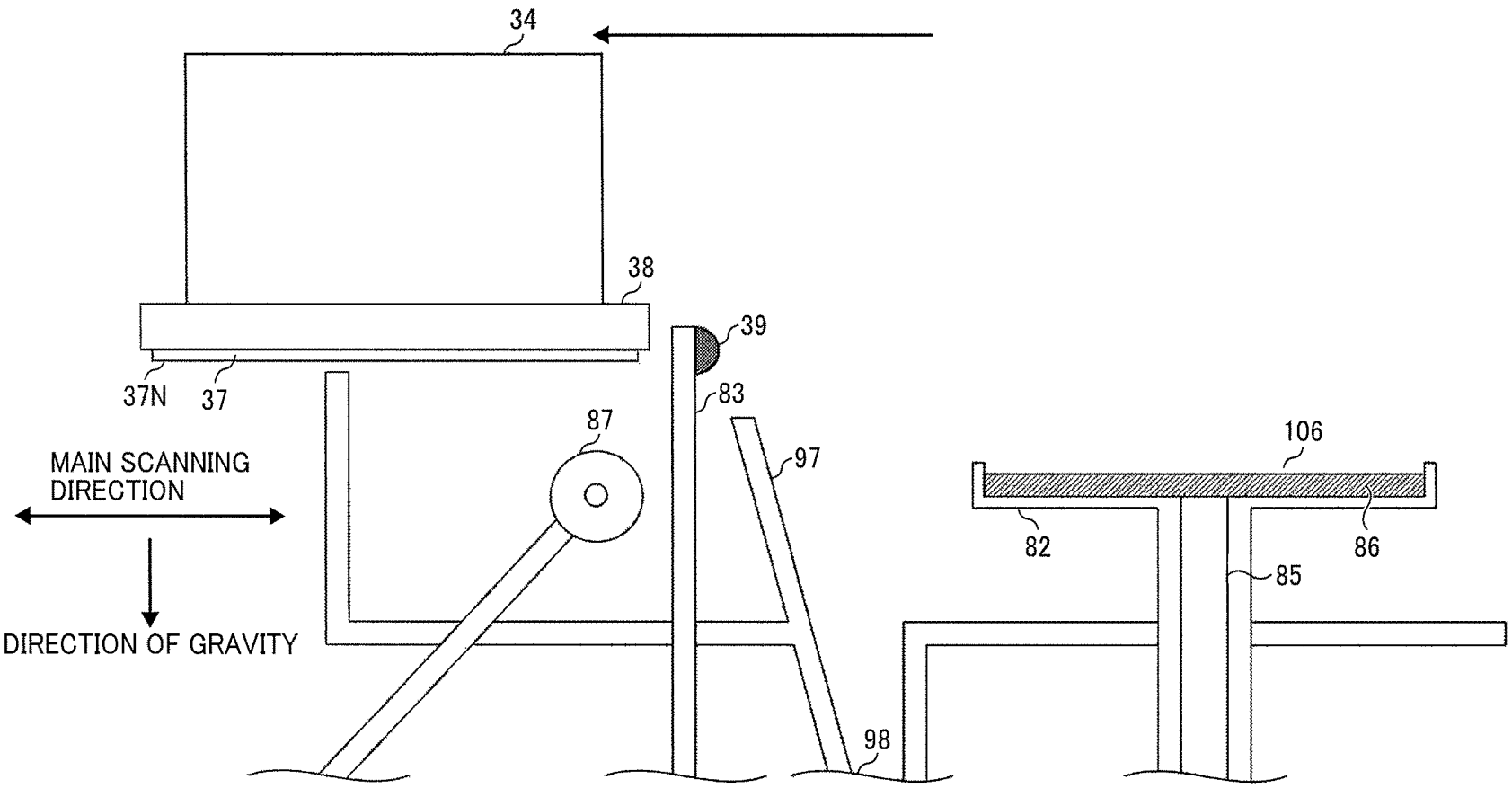
FIG. 8 is a cross-sectional view of the inkjet printer illustrated in FIG. 1, as viewed in the sub-scanning direction.

Then, as illustrated in FIGS. 7 and 8, the inkjet printer 1 moves the liquid discharge head 34 in the main scanning direction. With this movement, the wiper blade 83 wipes the nozzle face 37N of the nozzle plate 37 to transfer the ink 39 adhering the nozzle face 37N to the wiper blade 83.

Figure 9:
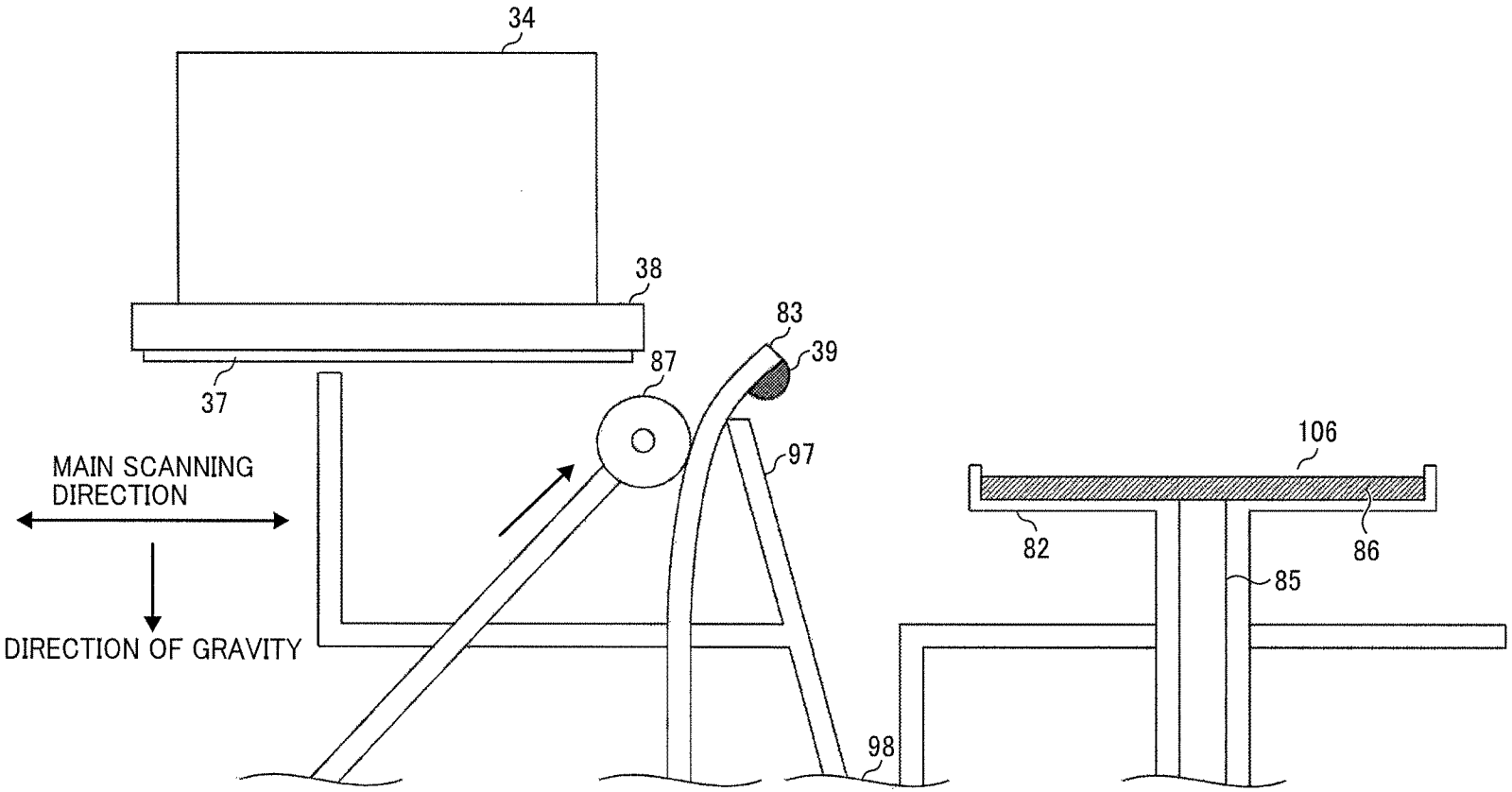
FIG. 9 is a cross-sectional view of the inkjet printer illustrated in FIG. 1, as viewed in the sub-scanning direction.
Figure 10:
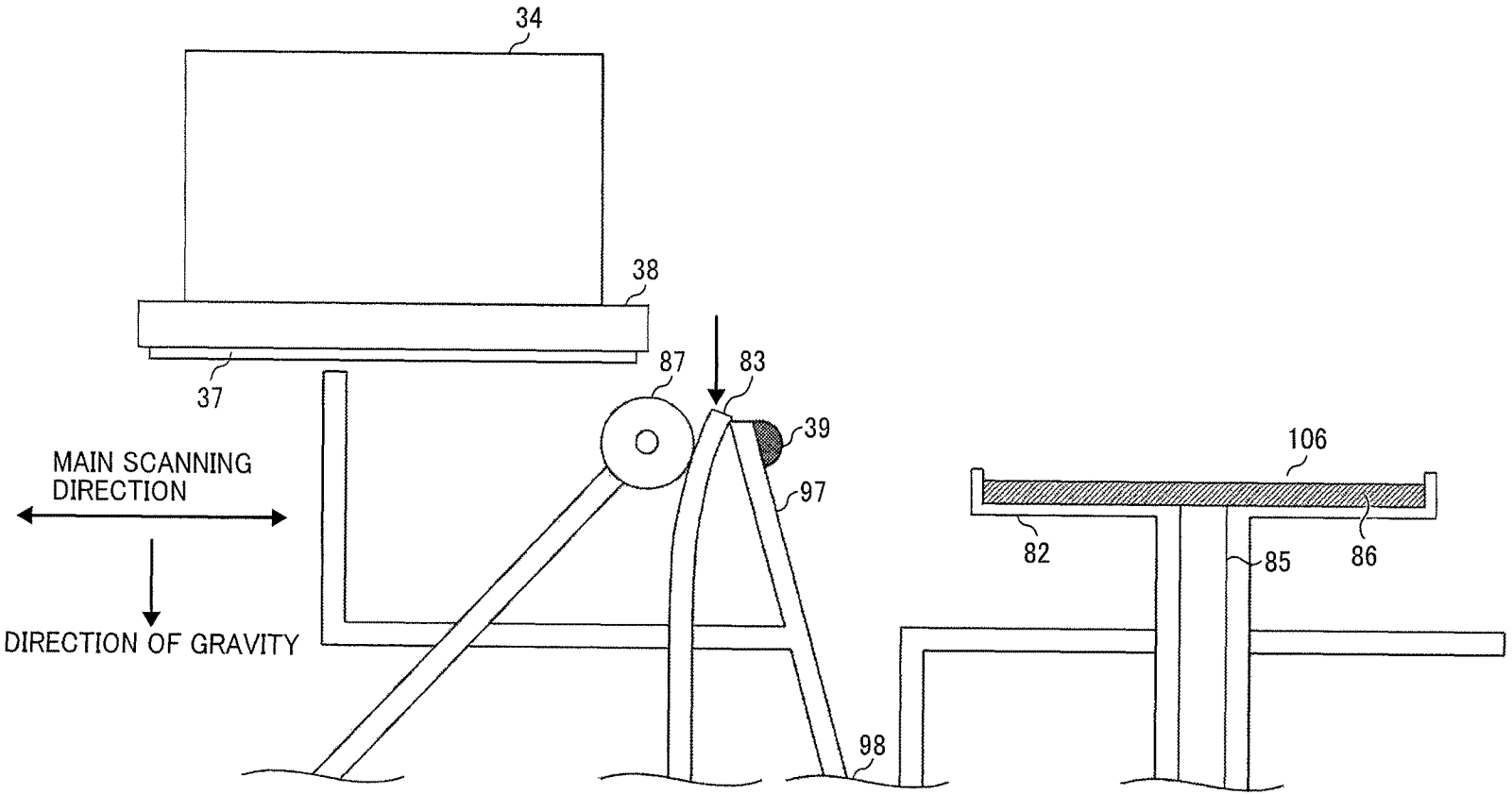
FIG. 10 is a cross-sectional view of the inkjet printer illustrated in FIG. 1, as viewed in the sub-scanning direction.

Subsequently, while the cleaner roller 87 presses the wiper blade 83 against the wiper scraper 97 as illustrated in FIG. 9, the inkjet printer 1 lowers the wiper blade 83 in the direction of gravity as illustrated in FIG. 10. With this movement, the ink 39 adhering to the wiper blade 83 is transferred to the wiper scraper 97.

Figure 11:
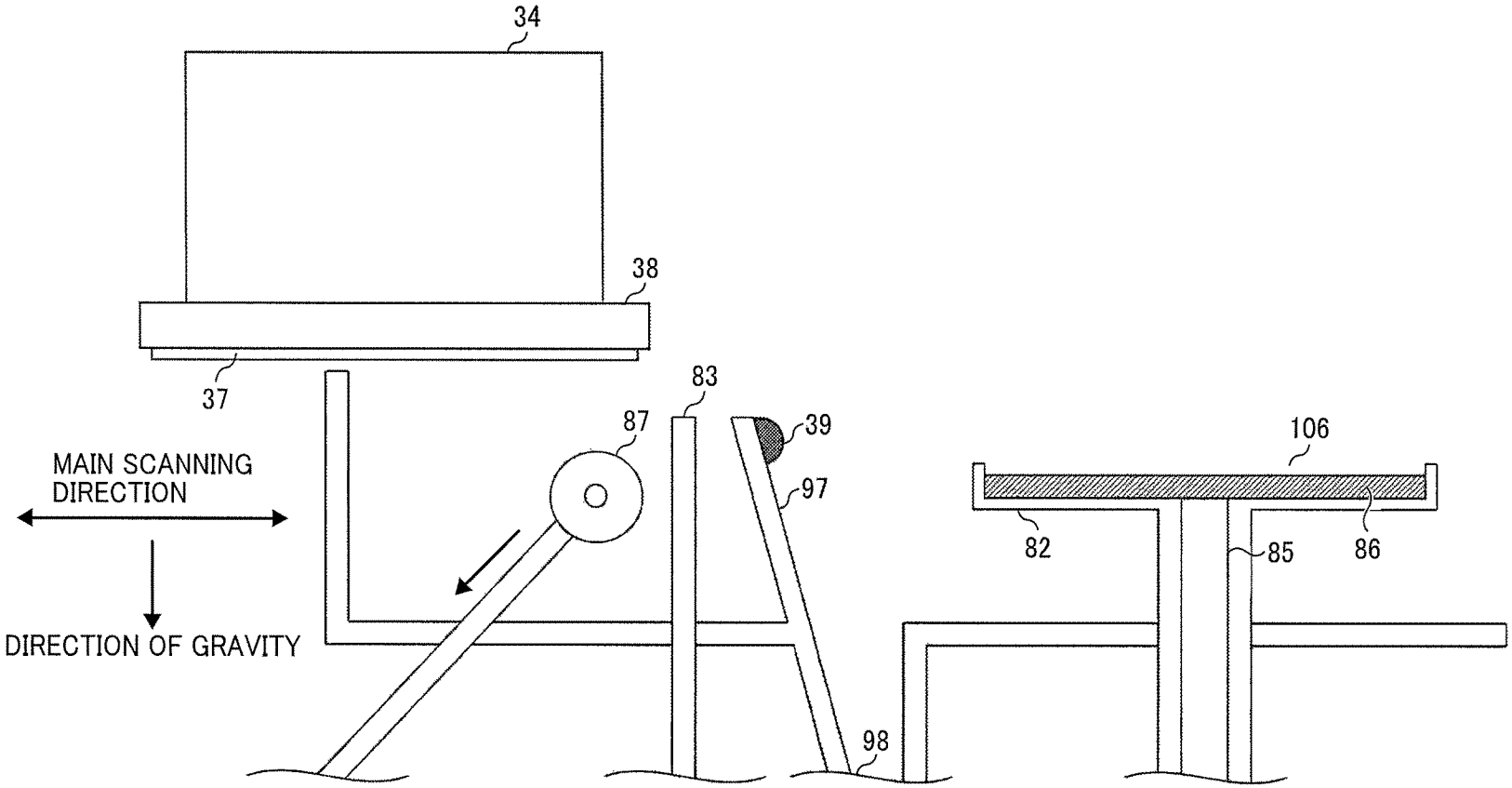
FIG. 11 is a cross-sectional view of the inkjet printer illustrated in FIG. 1, as viewed in the sub-scanning direction.
Figure 12:
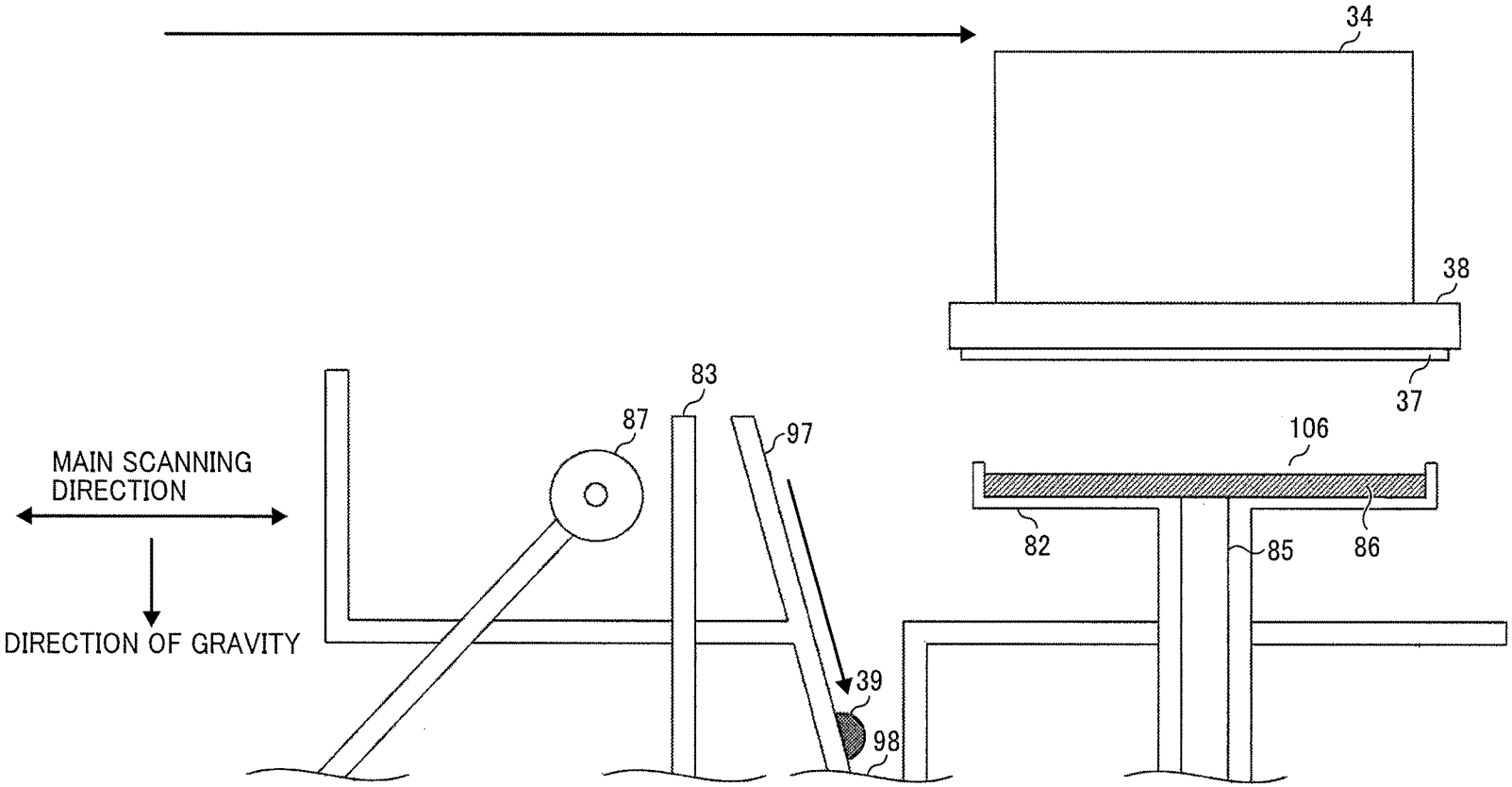
FIG. 12 is a cross-sectional view of the inkjet printer illustrated in FIG. 1, as viewed in the sub-scanning direction.

After returning the cleaner roller 87 to a home position as illustrated in to FIG. 11, the inkjet printer 1 returns the liquid discharge head 34 to a home position (a capped position) as illustrated in FIG. 12. At that time, the ink adhering to the wiper scraper 97 falls under the gravity along the passage 98 and is collected in the waste liquid container.

Figure 13:
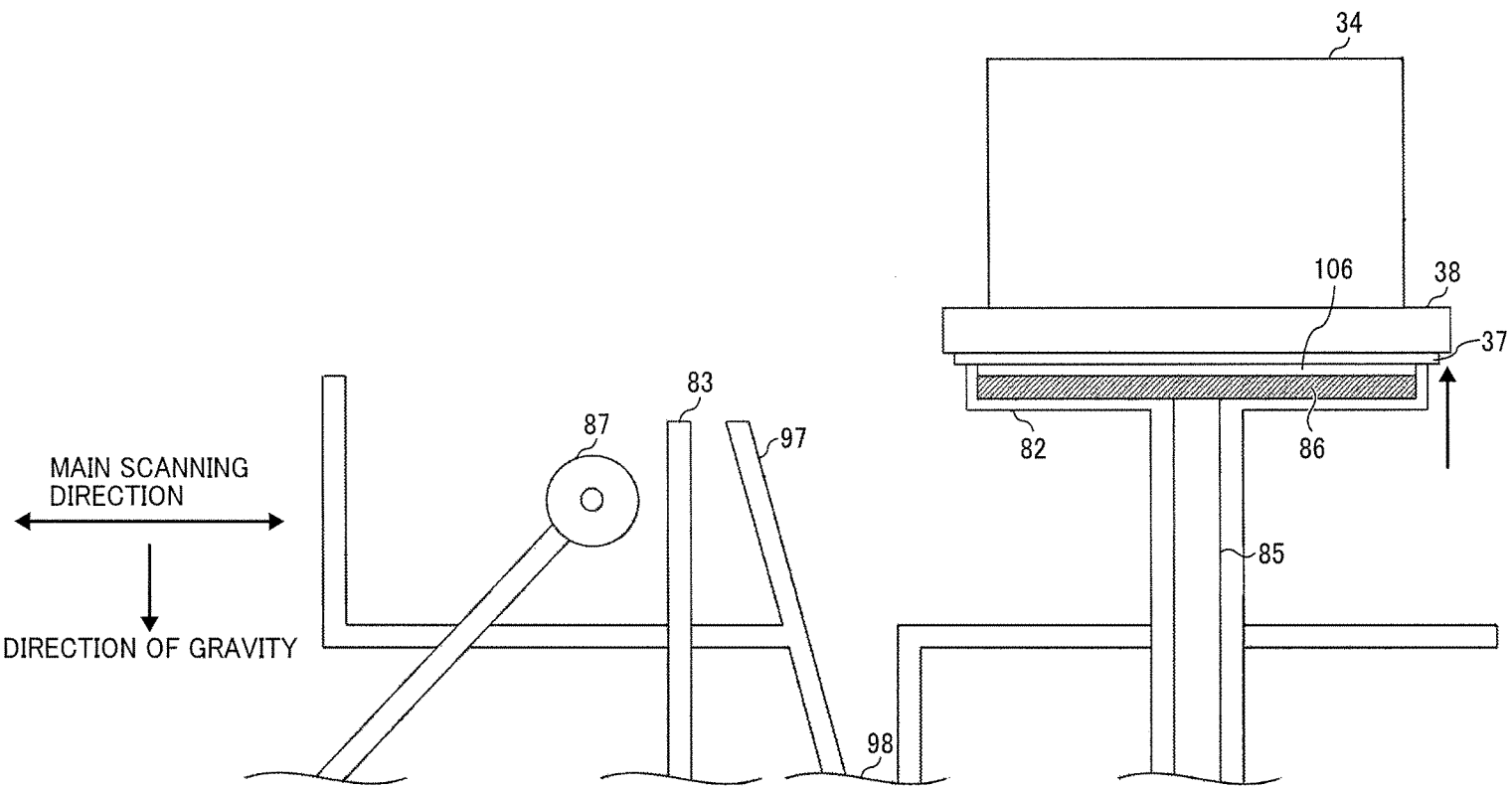
FIG. 13 is a cross-sectional view of the inkjet printer illustrated in FIG. 1, as viewed in the sub-scanning direction.

Subsequently, after the liquid discharge head 34 moves to the capped position, as illustrated in FIG. 13, the inkjet printer 1 lifts the nozzle caps 82 in the direction of gravity to cap the nozzle face 37N of the nozzle plate 37.

The actions described above are performed in wiping of the nozzle face 37N of the liquid discharge head 34 in the inkjet printer 1.

In the inkjet printer 1 according to the present embodiment, the ink 39 adhering to the liquid discharge head 34 and the nozzle face 37N is wiped away by such a wiping operation.

Figure 14:
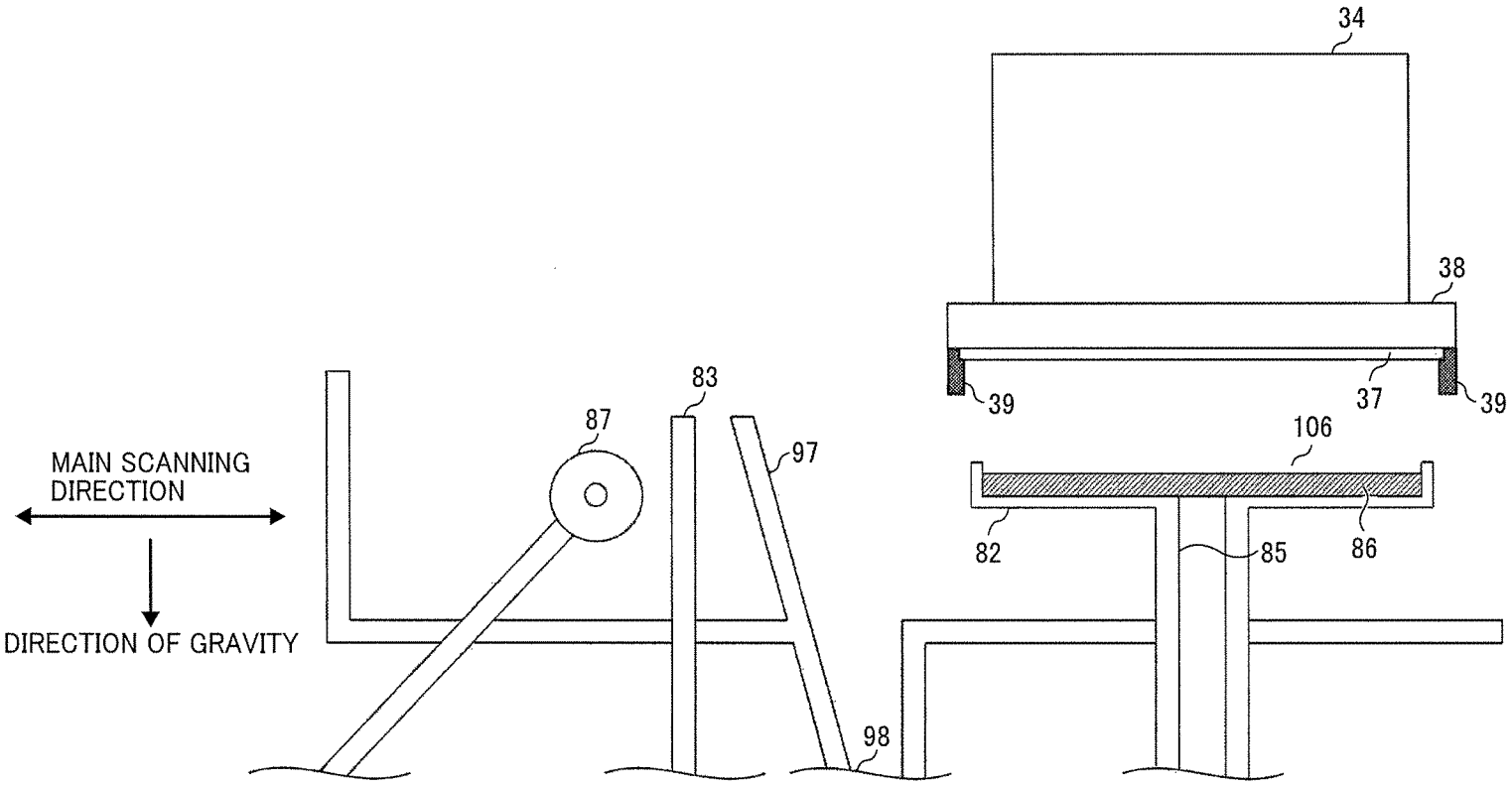
FIG. 14 is a cross-sectional view of a comparative inkjet printer, as viewed in the sub-scanning direction.
Figure 15:
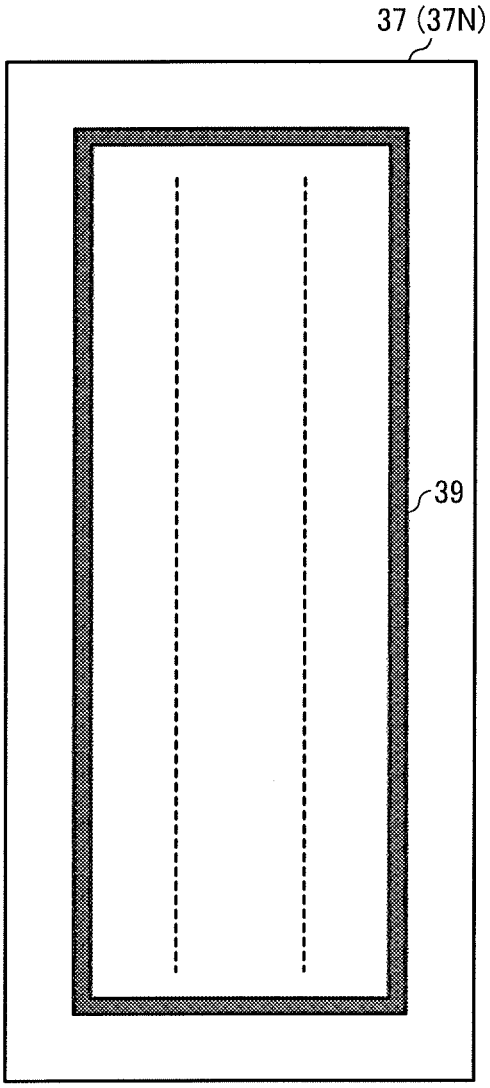
FIG. 15 is a bottom view of a nozzle plate in the comparative inkjet printer, as viewed from below.

However, it is difficult to fully wipe away the ink 39 from the nozzle face 37N, with the wiping of the nozzle face 37N of the nozzle plate 37 of the liquid discharge head 34. Accordingly, it is possible that the remaining ink 39 (hereinafter also "residual ink") dries to solidify and accumulates. Then, the solidified ink 39 may hang from the end of the liquid discharge head 34 (e.g., the end of the nozzle plate 37) as illustrated in FIG. 14, or the contact portion (e.g., a contact portion 37C in FIG. 16) between the nozzle plate 37 and the nozzle cap 82 may be smeared with the solidified ink 39 as illustrated in FIG. 15. Accordingly, there is a risk of defective printing or defective liquid discharge even if the nozzle face 37N of the liquid discharge head 34 are wiped.

FIG. 14 is a cross-sectional view of a comparative inkjet printer, as viewed in the sub-scanning direction. FIG. 15 is a bottom view of the nozzle plate 37 in the comparative inkjet printer. The above-described inconveniences are less likely to occur in the portion of the nozzle plate 37 corresponding to the space inside the nozzle cap 82 since the space capped by the nozzle cap 82 is moisturized.

Figure 16:
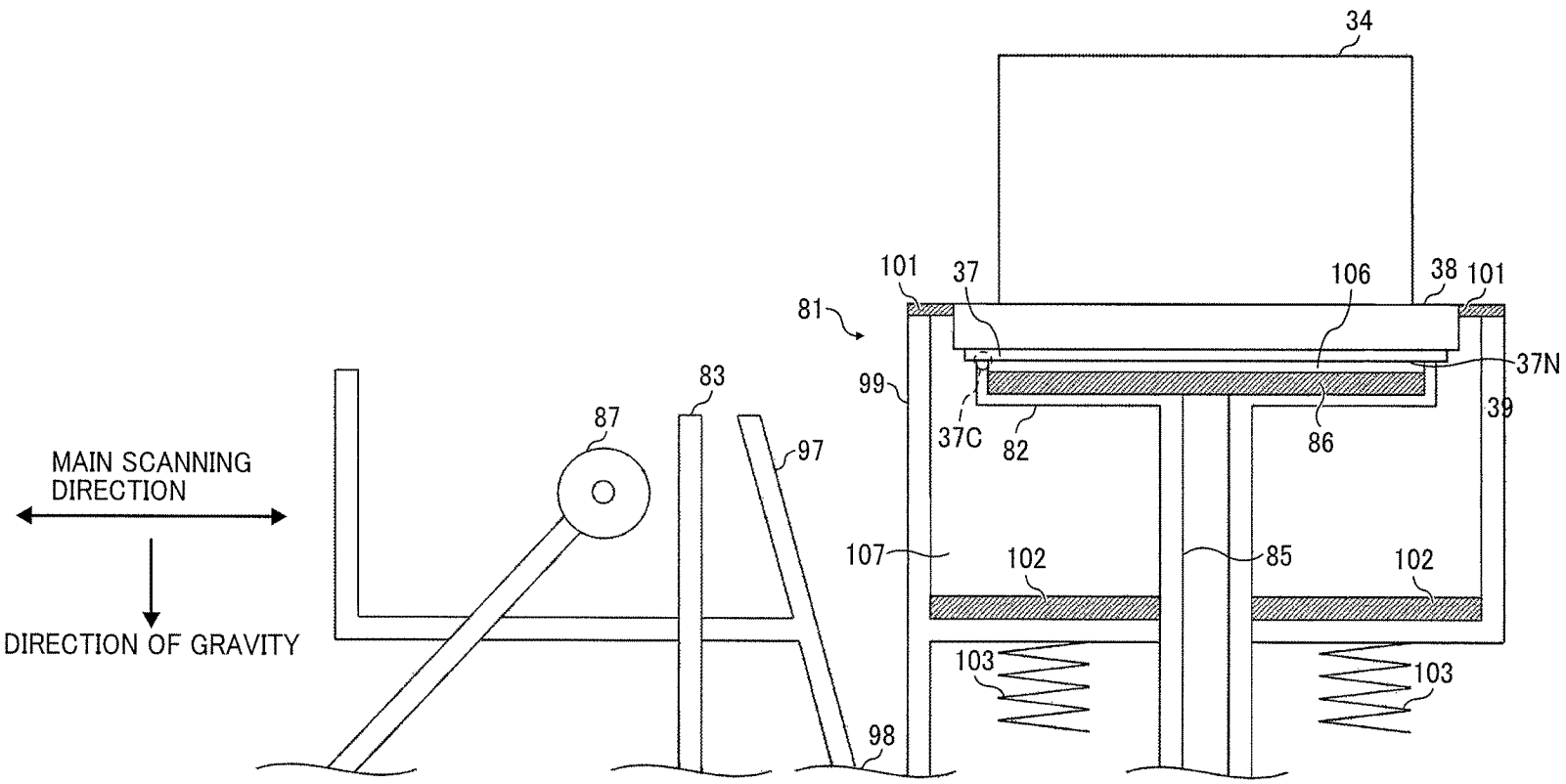
FIG. 16 is a cross-sectional view of an inkjet printer including a head cap (a second cap) according to an embodiment, as viewed in the sub-scanning direction.
Figure 17:
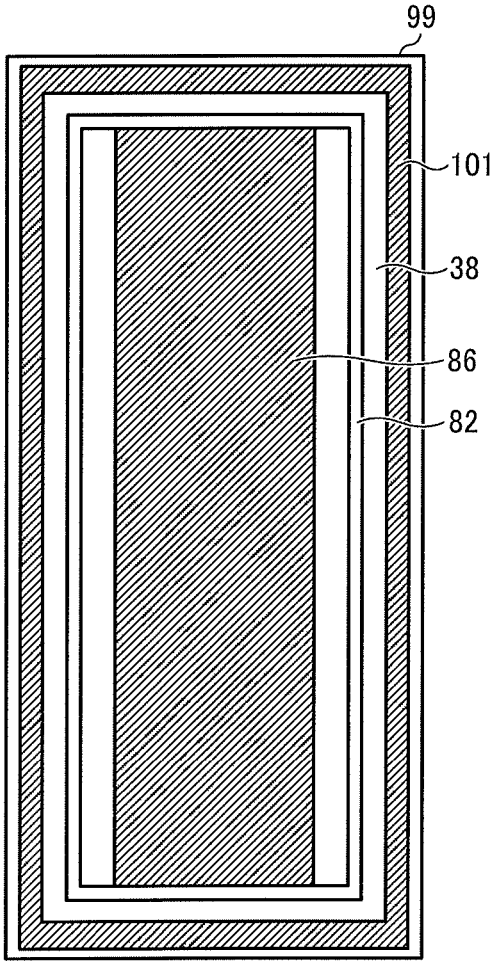
FIG. 17 is a top view of a nozzle cap and the head cap in the inkjet printer illustrated in FIG. 16.

In view of the foregoing, as illustrated n FIGS. 16 and 17, in the inkjet printer 1 according to the present embodiment, the maintenance device 81 further includes a head cap 99 (a second cap) disposed outside the nozzle cap 82 and designed to cover the nozzle face 37N of the liquid discharge head 34 entirely to the end. For example, in the structure illustrated in FIG. 16, the head cap 99 is disposed outside the nozzle plate 37 to cover the nozzle plate 37 entirely to the end. The head cap 99 seals the space including the contact portion 37C between the nozzle plate 37 and the nozzle cap 82 and the end (lower end in FIG. 16) of the liquid discharge head 34, which is hereinafter referred to as "head cap interior 107" (second space). The head cap 99 moisturizes the head cap interior 107. As illustrated in FIGS. 16 and 17, the head cap 99 according to the present embodiment includes an outside-air shutter 101 and a humidity conditioner 102. Since a plurality of ink cartridges 10 is mounted in the inkjet printer 1 as described above, the inkjet printer 1 includes a plurality of nozzle plates 37. In the inkjet printer 1, the nozzle plates 37, one of which is illustrated in FIG. 15, are arranged in the lateral direction in FIG. 15.

FIG. 16 is a cross-sectional view of the inkjet printer 1 according to the present embodiment, as viewed in the sub-scanning direction. FIG. 17 is a top view of the nozzle cap 82 and the head cap 99 in the inkjet printer 1 according to the present embodiment.

The outside-air shutter 101 is disposed in tight contact with end of the liquid discharge head 34 on the side of the nozzle face 37N (hereinafter "nozzle formation side") to shut off the head cap interior 107 from outside air. The outside-air shutter 101 is made of a material including, for example, urethane rubber, silicon, or polyvinylidene chloride (PVDC).

The humidity conditioner 102 keeps the head cap interior 107 at a constant or almost constant humidity. In other words, the humidity conditioner 102 keeps the amount of vapor in the head cap interior 107 (hereinafter "vapor amount") at a constant amount. Specifically, the relative humidity (RH) of air in thermal equilibrium with a saturated aqueous solution of salt such as sodium chloride is determined by the type of the salt and the temperature of the solution. Accordingly, when the saturated solution of given salt is disposed in the head cap interior 107, the head cap interior 107 can be kept at a constant humidity. The term "vapor" generally represents a substance in a gas phase, and "vapor" in this disclosure represents steam, that is, water in gas phase. The term "vapor amount" represents the amount (e.g., mass, weight, number of moles, or the like) of vapor in a unit volume. The humidity conditioner 102 is contained in a container having a plurality of slits or a plurality of holes to generate vapor to adjust the humidity therearound.

With this structure, in the state in which the liquid discharge head 34 is capped with the head cap 99, the contact portion between the nozzle plate 37 and the nozzle cap 82 and the end (nozzle formation side) of the liquid discharge head 34 are moisturized. It is to be noted that one head cap 99 serving as the second cap can be configured to cap the plurality of nozzle caps 82. That is, the maintenance device 81 includes a single head cap 99. Alternatively, each of the nozzle caps 82 can be capped with one of a plurality of head caps 99.

Accordingly, the inkjet printer 1 according to the present embodiment can inhibit the residual ink from drying to solidify, and the ink remaining after the nozzle face 37N of the liquid discharge head 34 is wiped can be kept at a low viscosity. Thus, the wiping capability of the inkjet printer 1 according to the present embodiment is enhanced, thereby inhibiting defective printing and defective liquid discharge.

Additionally, this structure facilitates the maintenance of the liquid discharge head 34 with a simple structure and a low cost.

Figure 18:
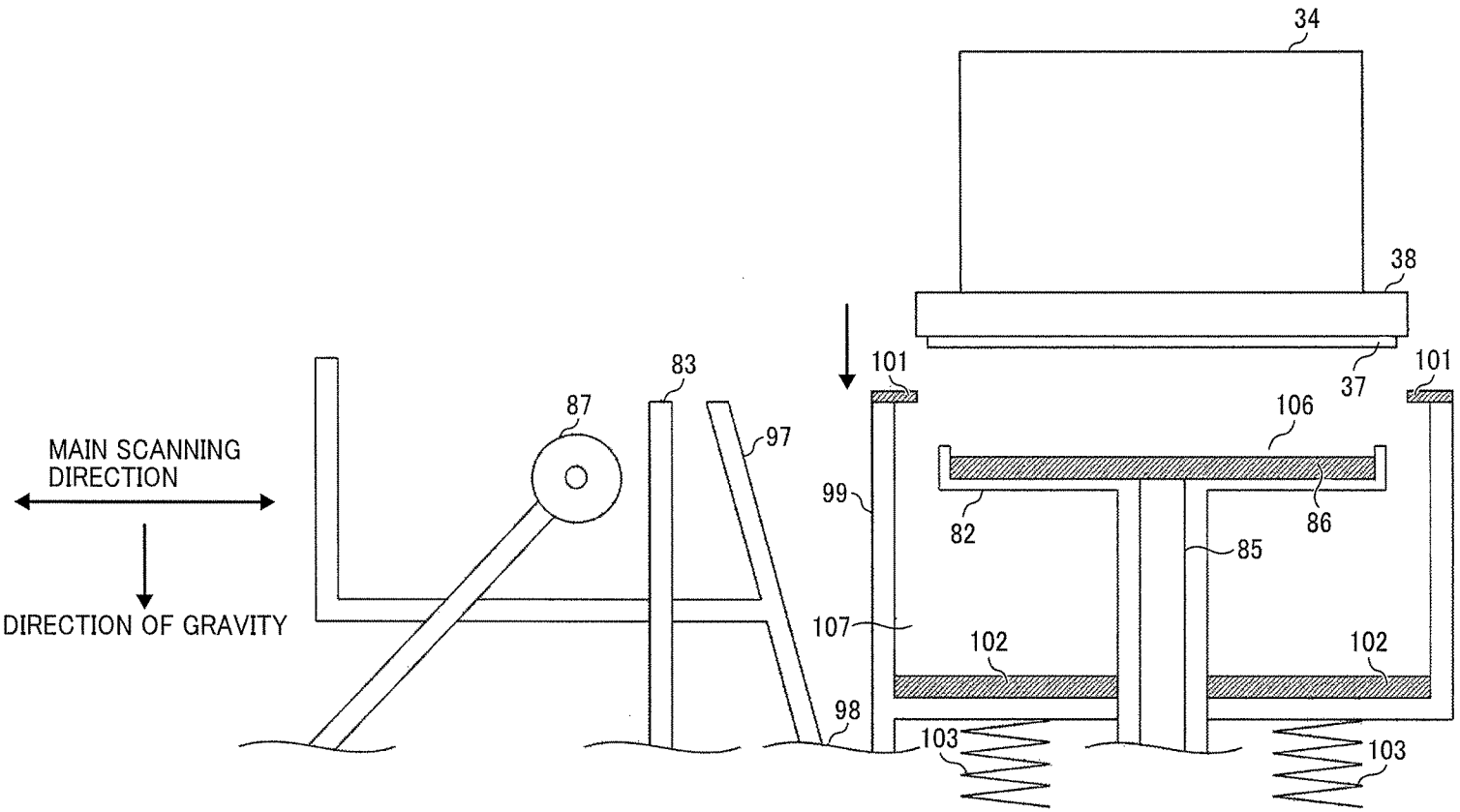
FIG. 18 is a cross-sectional view of the inkjet printer illustrated in FIG. 16, as viewed in the sub-scanning direction.

Further, as illustrated in FIG. 16, an impact absorber 103 is disposed below the head cap 99. The impact absorber 103 absorbs impact caused by vibration of the inkjet printer 1 so that the head cap 99 is not shaken to create a gap between the head cap 99 and the liquid discharge head 34 as the inkjet printer 1 vibrates. As illustrated in FIG. 18, the head cap 99 moves in conjunction with the nozzle cap 82. FIG. 18 is a cross-sectional view of the inkjet printer 1 according to the present embodiment, as viewed in the sub-scanning direction.

Figure 19:
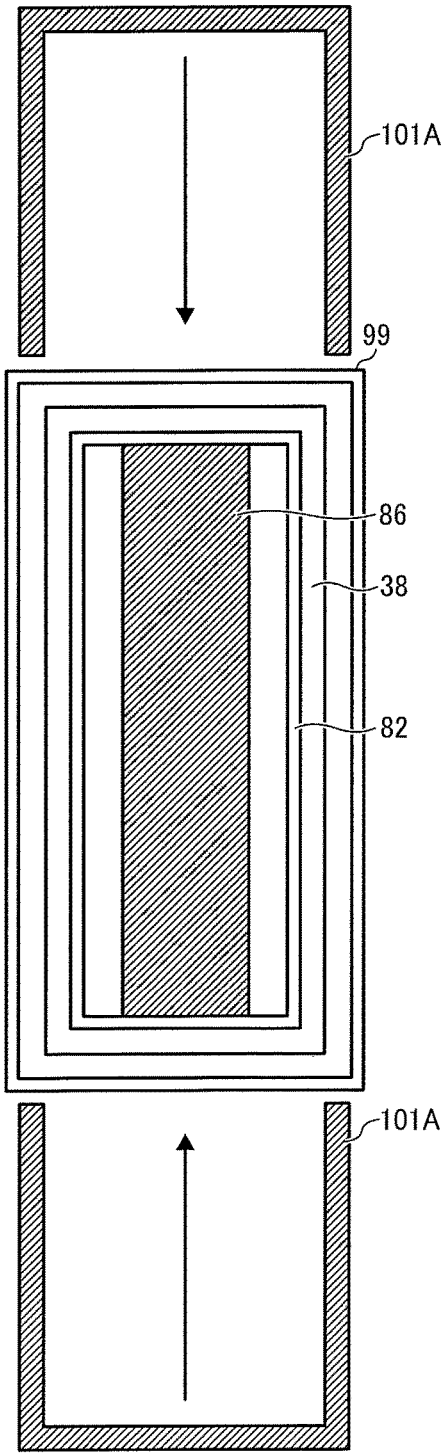
FIG. 19 is a top view of the nozzle cap and the head cap in the inkjet printer illustrated in FIG. 16.
Figure 20:
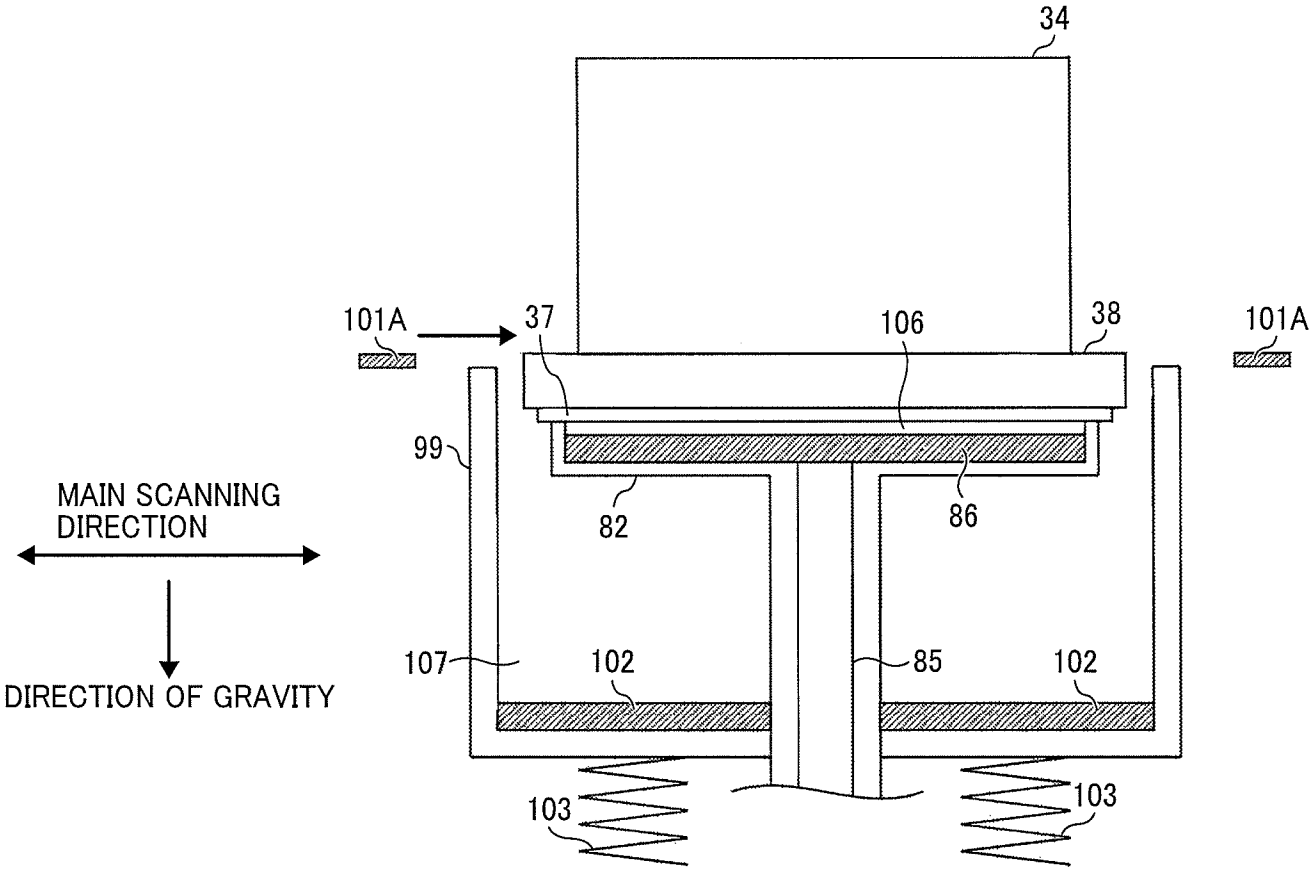
FIG. 20 is a cross-sectional view of the nozzle cap and the head cap in the inkjet printer illustrated in FIG. 16, as viewed in the sub-scanning direction.
Figure 21:
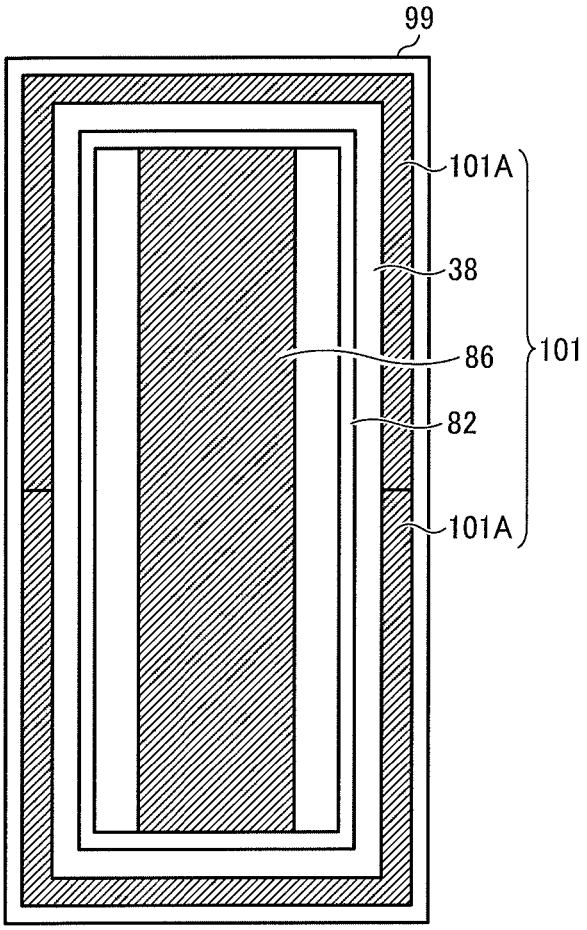
FIG. 21 is a top view of the nozzle cap and the head cap in the inkjet printer illustrated in FIG. 16.
Figure 22:
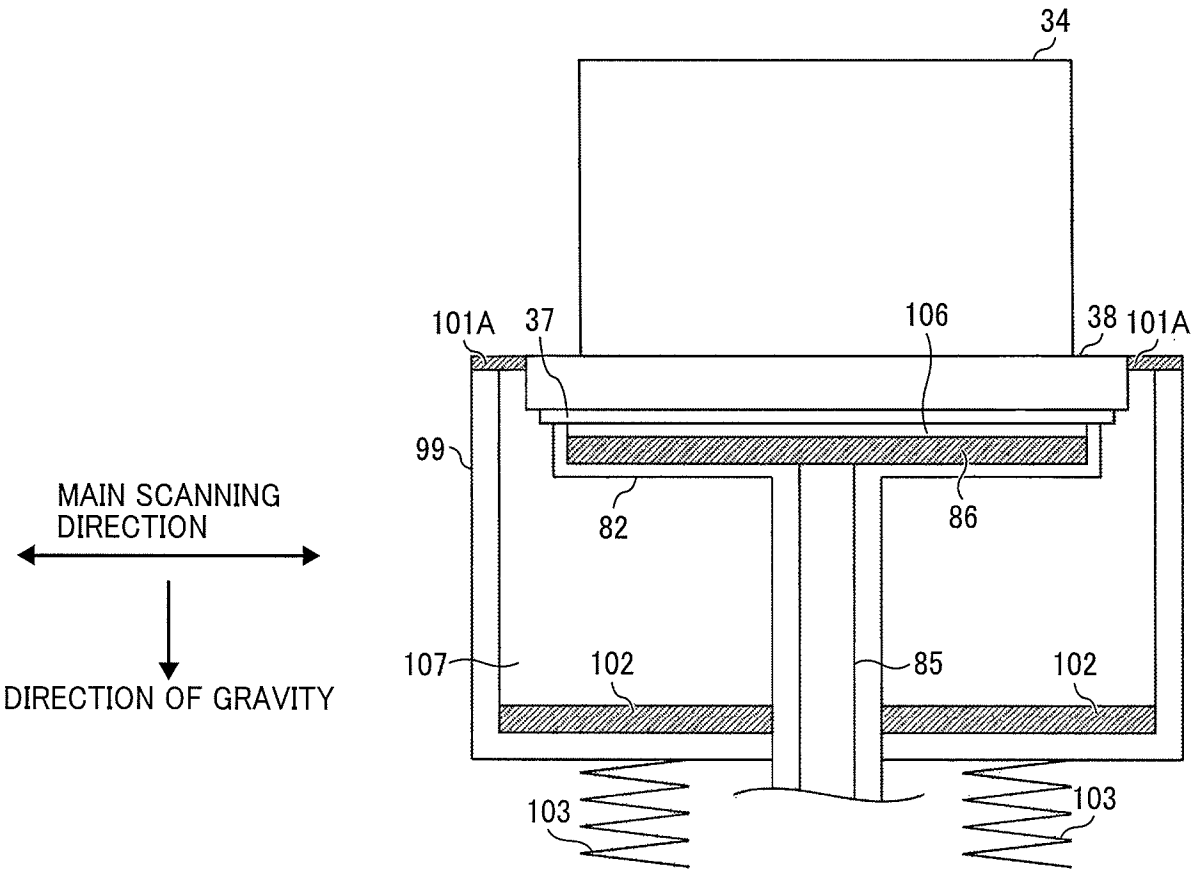
FIG. 22 is a cross-sectional view of the nozzle cap and the head cap in the inkjet printer illustrated in FIG. 16, as viewed in the sub-scanning direction.

Next, descriptions are given below of sealing of the head cap interior 107 by the outside-air shutter 101, with reference to FIGS. 19 through 22. FIGS. 19 and 21 are top views of the nozzle cap 82 and the head cap 99 in the inkjet printer 1 according to the present embodiment. FIGS. 20 and 22 are cross-sectional views of the nozzle cap 82 and the head cap 99 in the inkjet printer 1 according to the present embodiment, as viewed in the sub-scanning direction.

As illustrated in FIGS. 19 through 22, the outside-air shutter 101 includes two shutter halves 101A that approach to each other from two sides (upper side and lower side in FIG. 19), toward the nozzle plate 37 (the nozzle face 37N) of the liquid discharge head 34, and tightly contact the end (the nozzle formation side) of the liquid discharge head 34. Thus, the head cap interior 107 is sealed such that the nozzle formation side of the liquid discharge head 34 is covered entirely to the end.

Figure 23:
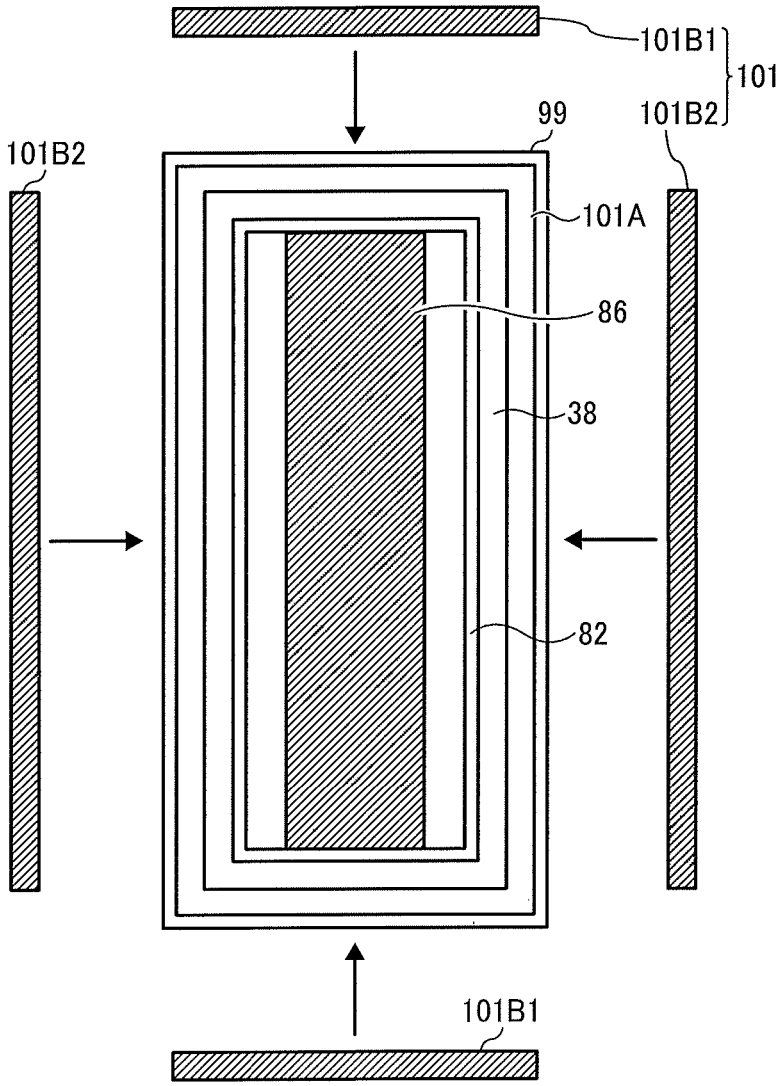
FIG. 23 is a top view of a nozzle cap and a head cap in an inkjet printer according to a variation.
Figure 24:
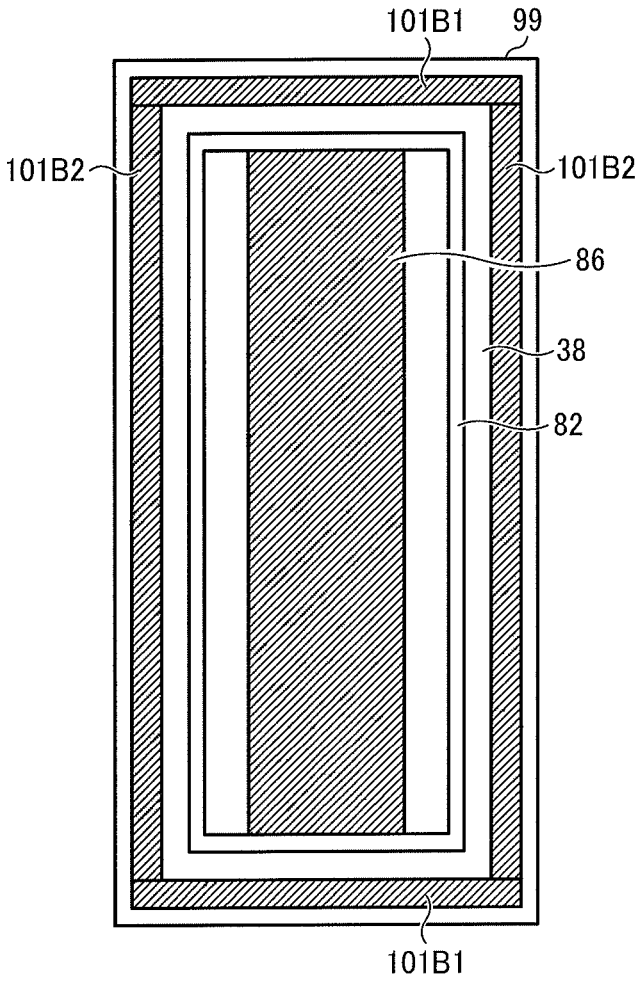
FIG. 24 is a top view of a nozzle cap and a head cap in an inkjet printer according to another variation.

Alternatively, as illustrated in FIGS. 23 through 24, the outside-air shutter 101 may include four pieces (shutter pieces 101B1 and 101B2) that approach to each other from four sides, toward the end (e.g., the nozzle plate 37) of the liquid discharge head 34, and tightly contact the nozzle formation side of the liquid discharge head 34. FIGS. 23 and 24 are top views of the nozzle cap 82 and the head cap 99 in the inkjet printer 1 according to the present embodiment.

Next, descriptions are given below of effect attained by the inkjet printer 1 according to the present embodiment, with reference to FIGS. 25 through 27.

Figure 25:
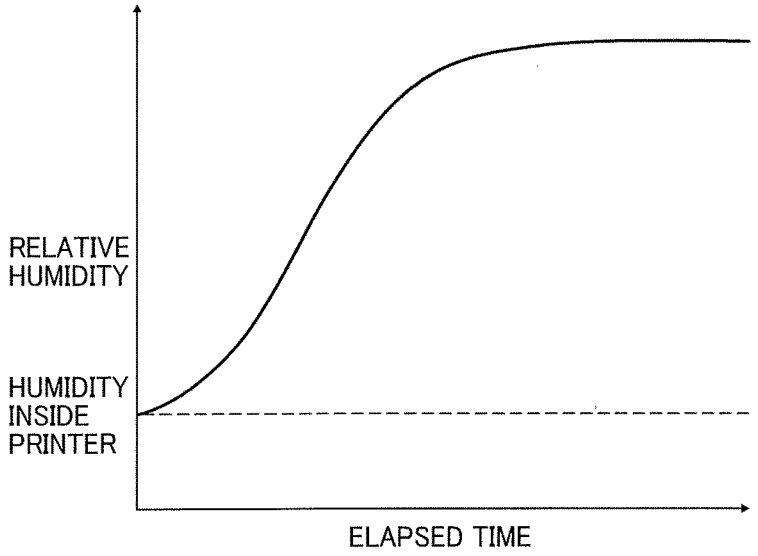
FIG. 25 is a graph of changes in relative humidity inside the head cap (i.e., head cap interior) when the liquid discharge head is capped with the head cap illustrated in FIG. 16.

FIG. 25 illustrates a graph of changes in the relative humidity (RH) of the head cap interior 107 while the liquid discharge head 34 is capped with the head cap 99.

FIG. 25 includes, for comparison, the graph of relative humidity in a configuration in which the head cap 99 is not provided. Specifically, in FIG. 25, the solid line represents the graph of relative humidity in the configuration including the head cap 99, and broken lines represent the graph of relative humidity in the configuration in which the head cap 99 is not provided. The graphs in FIG. 25 are on the assumption that the interior of the inkjet printer 1 is kept at a constant humidity.

Figure 26:
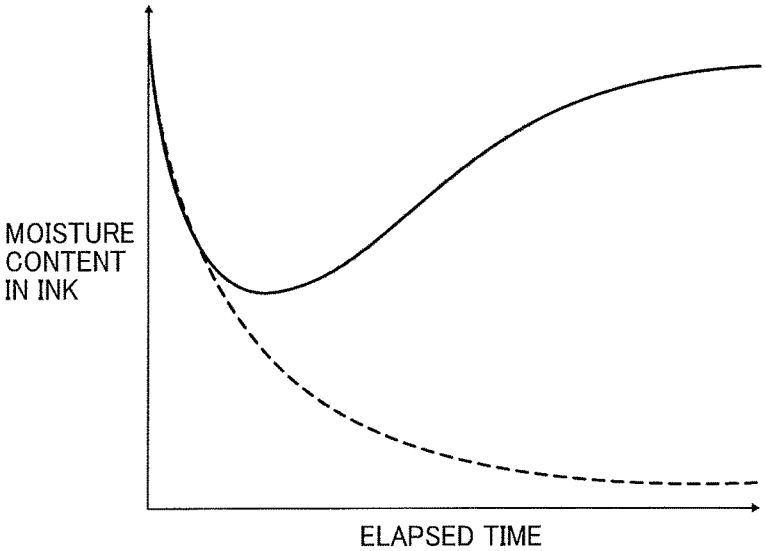
FIG. 26 is a graph of changes in moisture content in residual ink while the liquid discharge head is capped with the head cap illustrated in FIG. 16.

FIG. 26 illustrates a graph of changes in moisture content in the residual ink while the liquid discharge head 34 is capped with the head cap 99.

FIG. 26 includes, for comparison, the graph of moisture content in the configuration in which the head cap 99 is not provided. Specifically, in FIG. 26, the solid line represents the graph of moisture content in the configuration including the head cap 99, and broken lines represent the graph of moisture content in the configuration in which the head cap 99 is not provided. The graphs in FIG. 26 are on the assumption that the interior of the inkjet printer 1 is kept at a constant humidity.

Figure 27:
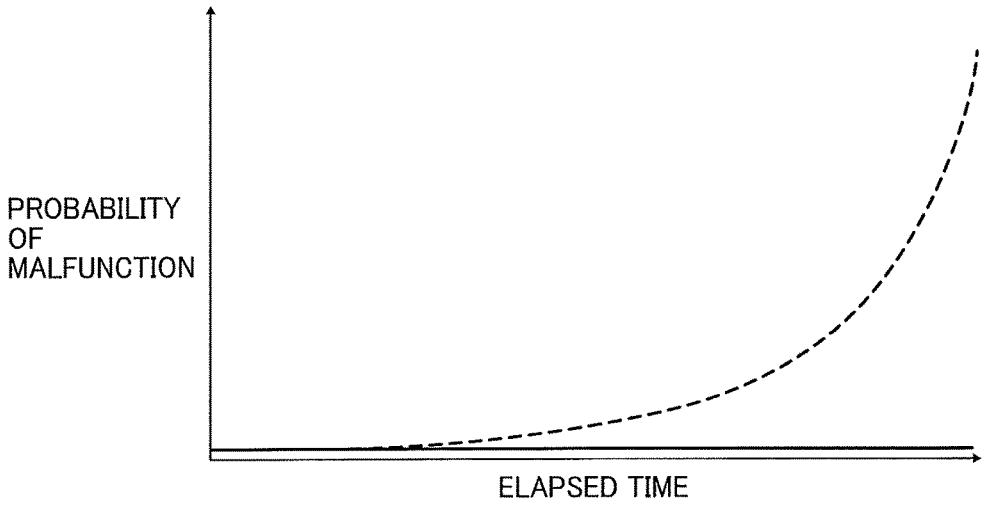
FIG. 27 is a graph of changes with time of probability of malfunction caused by residual ink in the inkjet printer illustrated in FIG. 16.

FIG. 27 illustrates changes with time of probability of malfunction caused by the residual ink in the inkjet printer 1 according to the present embodiment.

FIG. 27 includes, for comparison, the graph of probability of malfunction in the configuration in which the head cap 99 is not provided. Specifically, in FIG. 27, the solid line represents the graph in the configuration including the head cap 99, and broken lines represent the graph in the configuration in which the head cap 99 is not provided.

As illustrated in FIG. 25, while the liquid discharge head 34 is capped with the head cap 99 according to the present embodiment, the relative humidity of the head cap interior 107 increases with elapse of time and then becomes stable. By contrast, in the configuration in which the head cap 99 is not provided, the relative humidity remains identical or similar to the humidity inside the inkjet printer 1 with elapse of time.

Thus, the inkjet printer 1 according to the present embodiment can moisturize the nozzle formation side (lower end in FIG. 22) of the liquid discharge head 34 entirely in the state in which the liquid discharge head 34 is capped with the head cap 99.

Additionally, since the relative humidity inside the inkjet printer 1 is low as illustrated in FIG. 25, the moisture content in the residual ink decreases for a time immediately after the liquid discharge head 34 is capped with the head cap 99 according to the present embodiment, as illustrated in FIG. 26. However, as the relative humidity inside the inkjet printer 1 increases, the moisture content increases and becomes stable. By contrast, in the configuration in which the head cap 99 is not provided, since the moisture in the residual ink keeps evaporating, the moisture content keeps decreasing as well.

Thus, the inkjet printer 1 according to the present embodiment can inhibit the residual ink from drying to solidify, and, after the nozzle face 37N of the liquid discharge head 34 is wiped, the remaining ink can be kept at a low viscosity. Thus, the wiping capability of the inkjet printer 1 according to the present embodiment is enhanced, thereby inhibiting defective printing and defective liquid discharge.

Further, as illustrated in FIG. 27, according to the present embodiment, the probability of malfunction caused by the residual ink is kept at a relatively low rate with the improved wiping capability. By contrast, in the configuration in which the head cap 99 is not provided, the remaining ink 39 can dry, solidify, and accumulate. Then, the probability of malfunction keeps rising as the solidified ink 39 hangs from the end of the liquid discharge head 34 as illustrated in FIG. 14, or the contact portion between the nozzle plate 37 and the nozzle cap 82 is smeared with the solidified ink 39 as illustrated in FIG. 15. Thus, the inkjet printer 1 according to the present embodiment can prevent or reduce the occurrence of malfunction.

Figure 28:
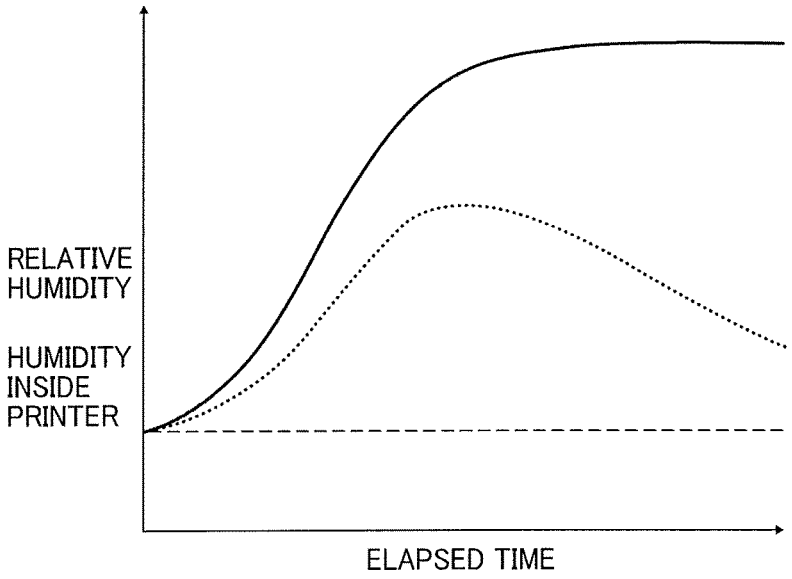
FIG. 28 illustrates a graph of relative humidity changes of the head cap interior moisturized by a humidity conditioner according to an embodiment and a graph of relative humidity changes of the head cap interior moisturized by a comparative humidity conditioner.

Next, descriptions are given below of a main ingredient of the humidity conditioner 102 in the inkjet printer 1 according to the present embodiment, with reference to FIG. 28. FIG. 28 illustrates graphs of changes in the relative humidity of the head cap interior 107 while the liquid discharge head 34 is capped with the head cap 99.

In FIG. 28, the solid graph represents the relative humidity in a case where the main ingredient of the humidity conditioner 102 is a saturated salt solution, and the dotted graph represents the relative humidity in a case where the main ingredient of the humidity conditioner 102 is either identical to the main ingredient of ink or glycerin. In FIG. 28, for comparison, the case where the head cap 99 is not provided is also illustrated. That is, the broken lines represent the graph in the configuration in which the head cap 99 is not provided. The graphs in FIG. 28 are on the assumption that the interior of the inkjet printer 1 is kept at a constant humidity.

As illustrated in FIG. 28, when the main ingredient of the humidity conditioner 102 is a saturated salt solution, a constant (or almost constant) humidity is maintained for a long time compared with the case where the main ingredient is identical to the main ingredient of ink or glycerin. Accordingly, when the saturated salt solution is used as the main ingredient of the humidity conditioner 102, the interior of the head cap 99 covering the liquid discharge head 34 can be moisturized better. However, the ingredient of ink or glycerin can be used.

The term "saturated salt solution" used here means a mixture of at least one powdered salt and at least one saturated aqueous solution of salt.

In the saturated salt solution used in the present embodiment, powdered salt is soaked in a saturated aqueous solution to maintain the shape of the humidity conditioner 102. Accordingly, in the present embodiment, the humidity conditioner 102 can be disposed at a given position regardless of the direction of gravity.

Additionally, in the present embodiment, the humidity conditioner 102 is disposed to avoid direct contact with a metal portion of the inkjet printer 1. When the container of the humidity conditioner 102 is made of a nonmetal material, corrosion of the container can be prevented. These features facilitate maintenance of the inkjet printer 1.

Next, descriptions are given below of the relative humidity of the head cap interior 107 capped with the head cap 99 when the main ingredient of the humidity conditioner 102 is a saturated salt solution, with reference to FIGS. 29 and 30.

Figures 29, 30:
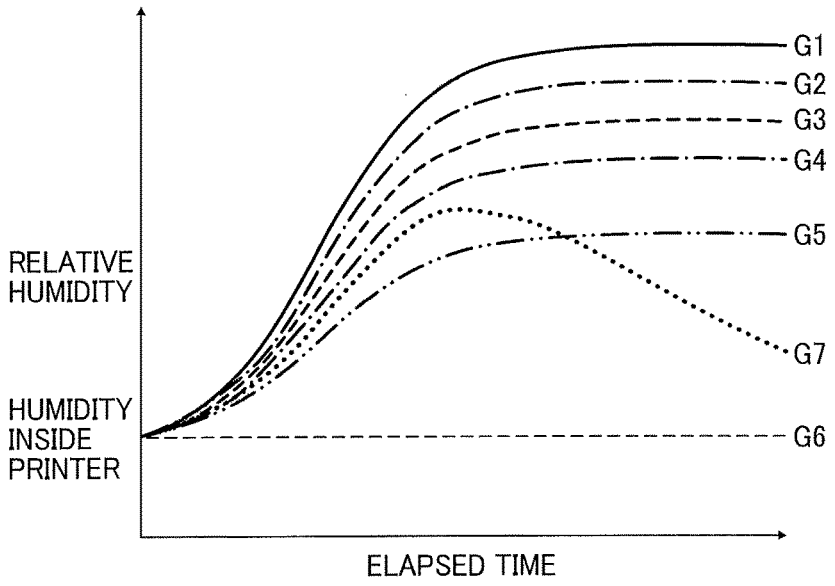
FIG. 29 is a table illustrating relations among relative humidity, types of saturated salt solutions, and temperature in a sealed space.
FIG. 30 illustrates graphs of relative humidity of the head cap interior attained by different saturated salt solutions according to an embodiment.

FIG. 29 is a table illustrating relations between relative humidity maintained by different types of saturated salt solutions and temperature in a sealed space. FIG. 30 illustrates graphs of changes in the relative humidity of the head cap interior 107 while the liquid discharge head 34 is capped with the head cap 99.

FIG. 30 illustrates a graph for each of the different saturated salt solutions presented in FIG. 29, used as the main ingredient of the humidity conditioner 102. That is, in FIG. 30, Graph G1 (solid line) corresponds to the case where potassium sulfate is used for the saturated salt solution, Graph G2 (alternate long and short dashed lines) corresponds to the case where potassium chloride is used for the saturated salt solution, Graph G3 (long broken lines) corresponds to the case where sodium chloride is used for the saturated salt solution, Graph G4 (alternate long line and dot) corresponds to the case where sodium bromide is used for the saturated salt solution, and Graph G5 (chain double-dashed line) corresponds to the case where potassium carbonate is used for the saturated salt solution.

In FIG. 30, for comparison, the case where the head cap 99 is not provided is also illustrated. That is, Graph G6 (broken lines) represent the case where the head cap 99 is not provided. Additionally, FIG. 30 also presents the case where the main ingredient of the humidity conditioner 102 is identical to the main ingredient of ink or glycerin for comparison. That is, Graph G7 (dotted graph) corresponds to the case where the main ingredient of the humidity conditioner 102 is identical to the main ingredient of ink or glycerin. The graphs in FIG. 30 are on the assumption that the interior of the inkjet printer 1 is kept at a constant humidity.

Although potassium sulfate, potassium chloride, sodium chloride, sodium bromide, and potassium carbonate are presented as example salts for the saturated salt solution in FIGS. 29 and 30, the salt for the saturated salt solution is not limited thereto as long as the salt can keep the sealed space at or above a given relative humidity.

Use of a salt capable of keeping the relative humidity of a sealed space equal to or higher than 40% is advantageous in moisturizing the space of the liquid discharge head 34 capped with the head cap 99. The saturated salt solutions presented in FIG. 29 satisfy this condition. Preferably, the salt used for the saturated salt solution is environmentally friendly and imposes fewer effects on human body. For example, sodium chloride is preferable.

Figure 31:
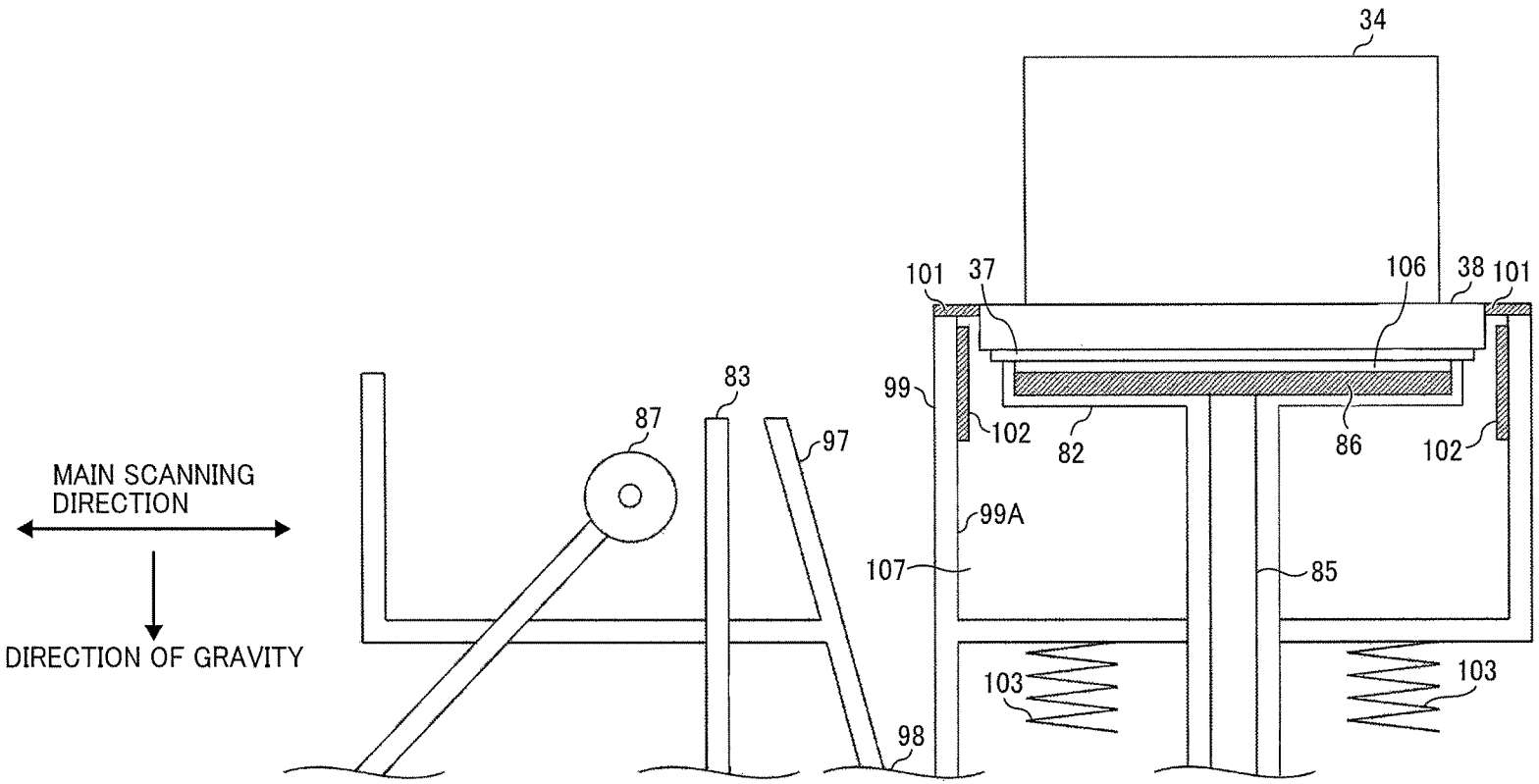
FIG. 31 is a cross-sectional view of the inkjet printer as viewed in the sub-scanning direction and illustrates a location of the humidity conditioner according to an embodiment.

The location of the humidity conditioner 102 is not limited to the bottom of interior of the head cap 99 illustrated in FIG. 16, as long as the location is inside the head cap 99. For example, the humidity conditioner 102 can be disposed opposing an end portion of the liquid discharge head 34 on the nozzle formation side as illustrated in FIG. 31. That is, the humidity conditioner 102 is disposed on a side face 99A of the head cap 99. FIG. 31 is a cross-sectional view of the inkjet printer 1 according to the present embodiment, as viewed in the sub-scanning direction.

When the humidity conditioner 102 is disposed on the side face 99A of the head cap 99 as illustrated in FIG. 31, the following advantage is available. In such an arrangement, the humidity conditioner 102 is close to the end of the liquid discharge head 34 and the contact portion between the nozzle plate 37 and the nozzle cap 82, in which the ink tends to remain after the nozzle face 37N is wiped.

Figure 32:
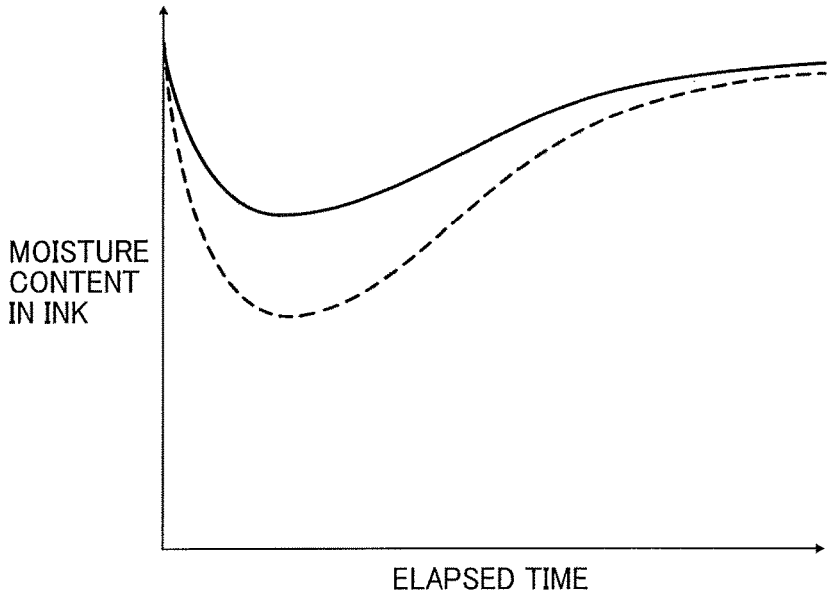
FIG. 32 is a graph of changes in moisture content in the residual ink while the liquid discharge head is capped with the head cap, in the arrangement illustrated in FIG. 31.

Accordingly, with such an arrangement, as illustrated in FIG. 32, the moisture content at the above-mentioned end or the above-mentioned contact portion can be higher than the moisture content maintained in the arrangement in which the humidity conditioner 102 is disposed at the bottom of interior of the head cap 99.

Thus, the wiping capability of the inkjet printer 1 according to the present embodiment is enhanced, thereby inhibiting defective printing and defective liquid discharge. FIG. 32 is a graph of changes in moisture content in the residual ink while the liquid discharge head 34 is capped with the head cap 99.

In FIG. 32, the solid line represents the graph in the arrangement in which the humidity conditioner 102 is disposed on the side face 99A of the head cap 99, and broken lines represent the graph in the arrangement in which the humidity conditioner 102 is disposed at the bottom of interior of the head cap 99. The graphs in FIG. 32 are on the assumption that the interior of the inkjet printer 1 is kept at a constant humidity.

Referring to FIG. 32, the moisture content of the residual ink decreases for a time immediately after the liquid discharge head 34 is sealed with the head cap 99 since the relative humidity inside the inkjet printer 1 is low as illustrated in FIG. 25. Then, in the arrangement in which the humidity conditioner 102 is disposed on the side face 99A of the head cap 99, the moisture content increases and becomes stable earlier, compared with the arrangement in which the humidity conditioner 102 is disposed at the bottom of interior of the head cap 99.

Accordingly, in the arrangement in which the humidity conditioner 102 is disposed on the side face 99A of the head cap 99, the moisture content at the end of the liquid discharge head 34 or the contact portion between the nozzle plate 37 and the nozzle cap 82 can be kept higher compared with the arrangement in which the humidity conditioner 102 is disposed at the bottom of interior of the head cap 99. Thus, the wiping capability of the inkjet printer 1 according to the present embodiment is enhanced, thereby inhibiting defective printing and defective liquid discharge.

However, when the humidity conditioner 102 is disposed at the bottom of interior of the head cap 99 as illustrated in FIG. 16, the entire head cap interior 107 can be moisturized uniformly compared with the arrangement in which the humidity conditioner 102 is disposed on the side face 99A of the head cap 99 as illustrated in FIG. 31.

In a variation, the humidity conditioner 102 is disposed at the bottom of interior of the head cap 99 as illustrated in FIG. 16, and another humidity conditioner 102 is disposed on the side face 99A of the head cap 99 as illustrated in FIG. 31. With such an arrangement, while the moisture content at the end of the liquid discharge head 34 or the contact portion between the nozzle plate 37 and the nozzle cap 82 can be kept at a higher content, the entire head cap interior 107 can be moisturized uniformly.

During printing, wiping, and the maintenance operation such as dummy discharge, the head cap 99 is disengaged from the liquid discharge head 34, exposing the interior of the head cap 99. As time elapses with the interior of the head cap 99 left unsealed, the relative humidity thereof continues to decrease.

Figure 33:
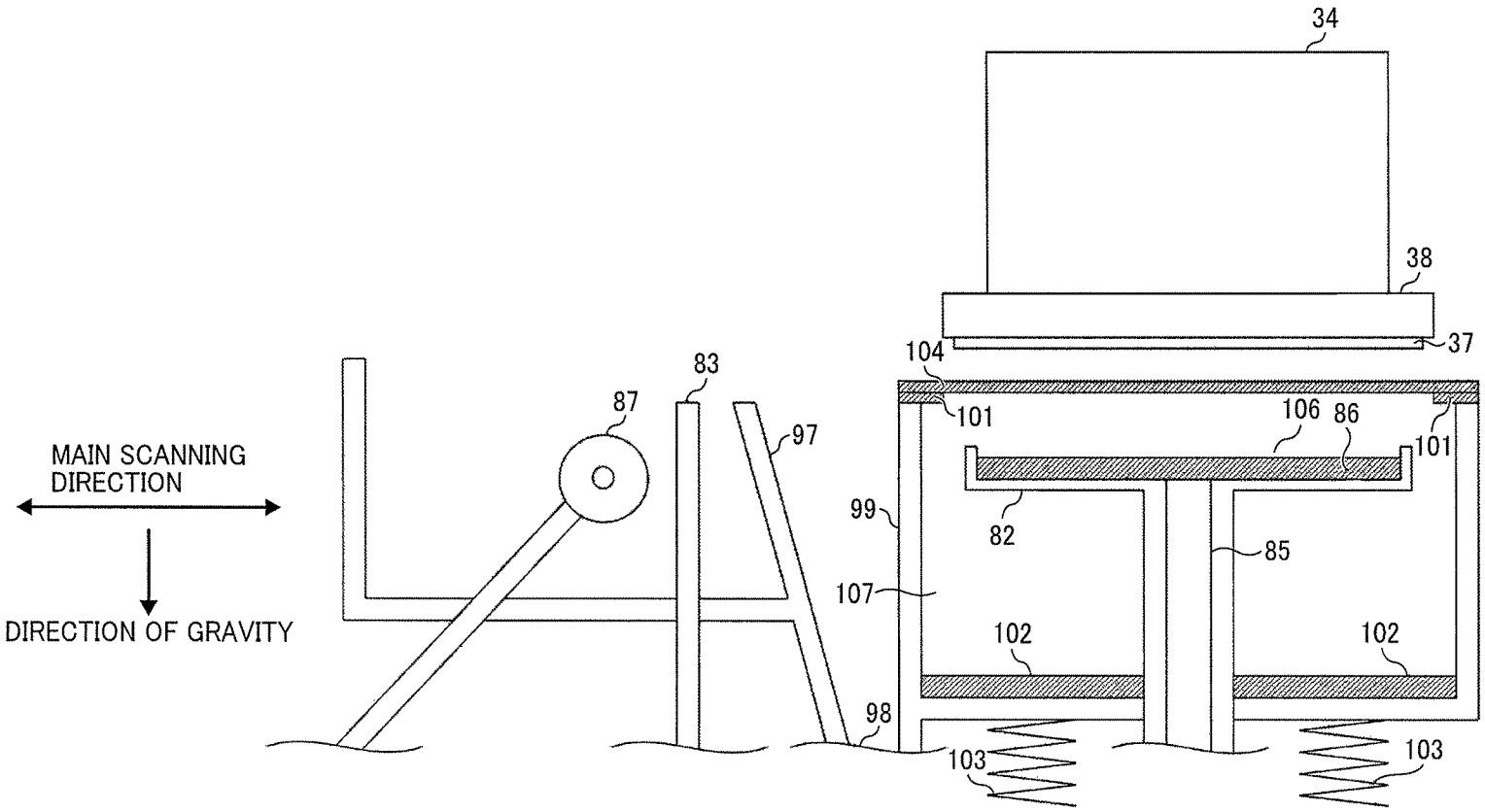
FIG. 33 is a cross-sectional view of an inkjet printer including a head cap cover (a sealed-state retainer) according to an embodiment, as viewed in the sub-scanning direction.

In view of the foregoing, as illustrated in FIG. 33, the inkjet printer 1 can further include a head cap cover 104 (a sealed-state retainer) to seal the head cap interior 107 when the head cap 99 is removed from the liquid discharge head 34 (the liquid discharge head 34 is not capped). FIG. 33 is a cross-sectional view of the inkjet printer 1, as viewed in the sub-scanning direction.

This structure can suppress changes in relative humidity of the head cap interior 107 when the head cap 99 is disengaged from the liquid discharge head 34.

Accordingly, this structure can moisturize the residual ink promptly after the liquid discharge head 34 is changed to the capped state from the unsealed state. Thus, the wiping capability of the inkjet printer 1 according to the present embodiment is enhanced, thereby inhibiting defective printing and defective liquid discharge.

Figure 34:
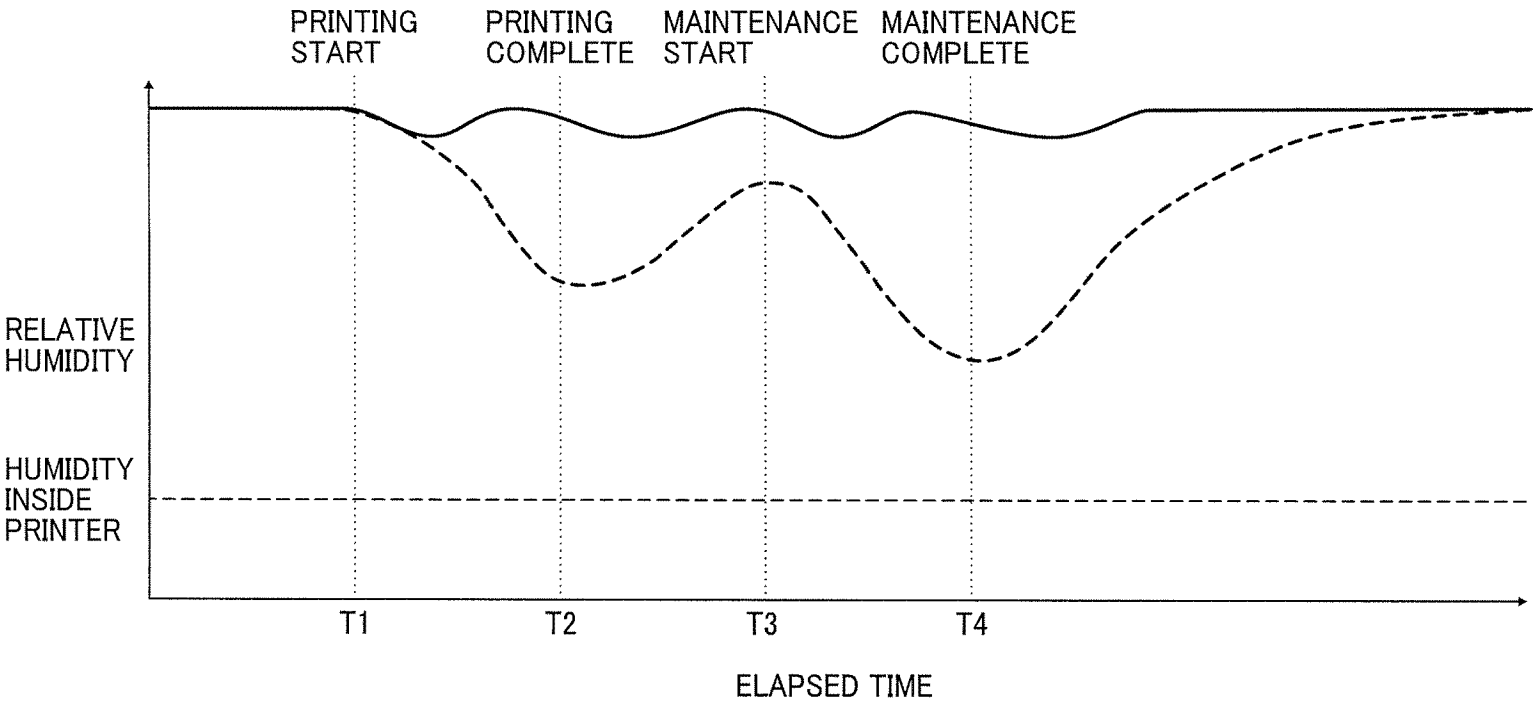
FIG. 34 illustrates a graph of relative humidity changes of the head cap interior when the liquid discharge head is capped with the head cap, in the structure illustrated in FIG. 33.

Descriptions are given below of changes in relative humidity of the head cap interior 107 when the head cap cover 104 covers the head cap 99, with reference to FIG. 34. FIG. 34 illustrates graphs of changes in the relative humidity of the head cap interior 107 while the liquid discharge head 34 is capped with the head cap 99.

FIG. 34 includes, for comparison, the case where the interior of the head cap 99 is not sealed with the head cap cover 104. That is, in FIG. 34, the solid graph corresponds to the case where the interior of the head cap 99 is sealed with the head cap cover 104, and the dotted graph corresponds to the case where the interior of the head cap 99 is not sealed with the head cap cover 104.

In FIG. 34, for comparison, the case where the head cap 99 is not provided is also illustrated. That is, in FIG. 34, the broken straight graph represents the relative humidity in the configuration in which the head cap 99 is not provided. The graphs in FIG. 34 are on the assumption that the interior of the inkjet printer 1 is kept at a constant humidity. In FIG. 34, the head cap 99 is removed at the start of printing at Time T1, and the liquid discharge head 34 is covered with the head cap 99 at Time T2 at which printing ends. At Time T3 at which maintenance operation starts, the head cap 99 is removed, and the liquid discharge head 34 is covered with the head cap 99 at Time T4 at which the maintenance operation ends.

As illustrated in FIG. 34, changes in the relative humidity of the head cap interior 107 can be suppressed by sealing the head cap interior 107 with the head cap cover 104 when the head cap 99 is disengaged from the liquid discharge head 34. By contrast, in the case where the head cap interior 107 is not sealed with the head cap cover 104 when the head cap 99 is disengaged from the liquid discharge head 34, the relative humidity of the head cap interior 107 continues to decrease from when the liquid discharge head 34 is uncapped until when the liquid discharge head 34 is capped again.

Accordingly, this structure can moisturize the residual ink promptly after the liquid discharge head 34 is changed to the capped state from the unsealed state. Thus, the wiping capability of the inkjet printer 1 according to the present embodiment is enhanced, thereby inhibiting defective printing and defective liquid discharge.

In the inkjet printer 1, the residual ink can adhere to, not only the liquid discharge head 34 and the nozzle face 37N, but also the wiper blade 83, the cleaner roller 87, and the wiper scraper 97. Accordingly, the wiping capability may be degraded as the ink adhering to the wiper blade 83, the cleaner roller 87, or the wiper scraper 97 dries to solidify and accumulates.

Figure 35:
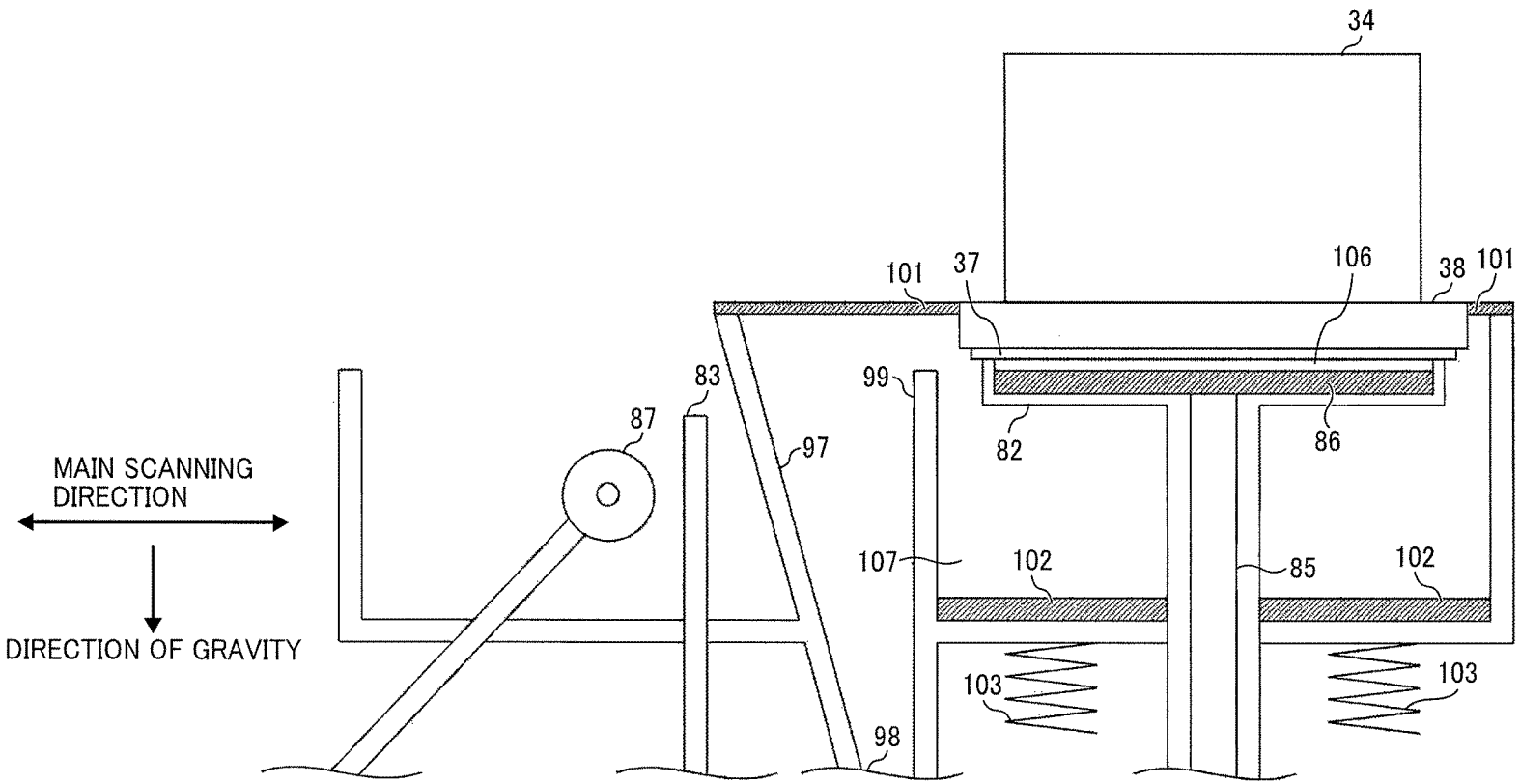
FIG. 35 is a cross-sectional view of an inkjet printer according to an embodiment, as viewed in the sub-scanning direction.
Figure 36:
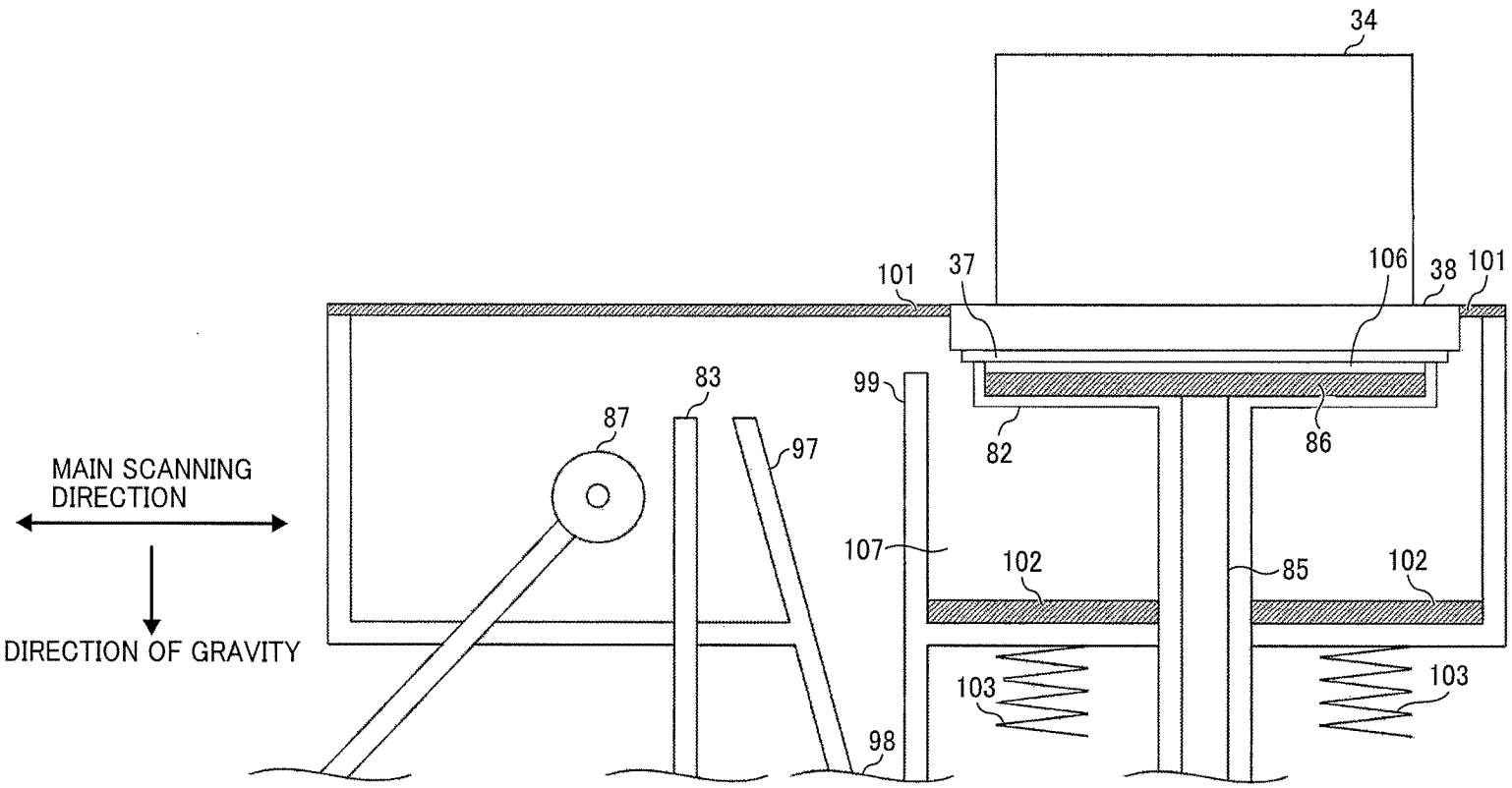
FIG. 36 is a cross-sectional view of an inkjet printer according to an embodiment, as viewed in the sub-scanning direction.

Therefore, the inkjet printer 1 can be configured such that the outside-air shutter 101 seals the space including, not only the liquid discharge head 34, but also the wiper scraper 97 as illustrated in FIG. 35, or the space further including the wiper blade 83 and the cleaner roller 87 as illustrated in FIG. 36. In performing head cleaning, the outside-air shutter 101 moves in either the main scanning direction or the sub-scanning direction to expose the upper side of the wiper blade 83. For example, a motor such as an electric motor can be used to move the outside-air shutter 101. FIGS. 35 and 36 are cross-sectional views of the inkjet printer 1, as viewed in the sub-scanning direction.

This structure can moisturize the space including the wiper blade 83, the cleaner roller 87, and the wiper scraper 97 and inhibit the residual ink adhering thereto from drying to solidify and accumulating. Thus, the wiping capability of the inkjet printer 1 according to the present embodiment is enhanced, thereby inhibiting defective printing and defective liquid discharge.

Figure 37:
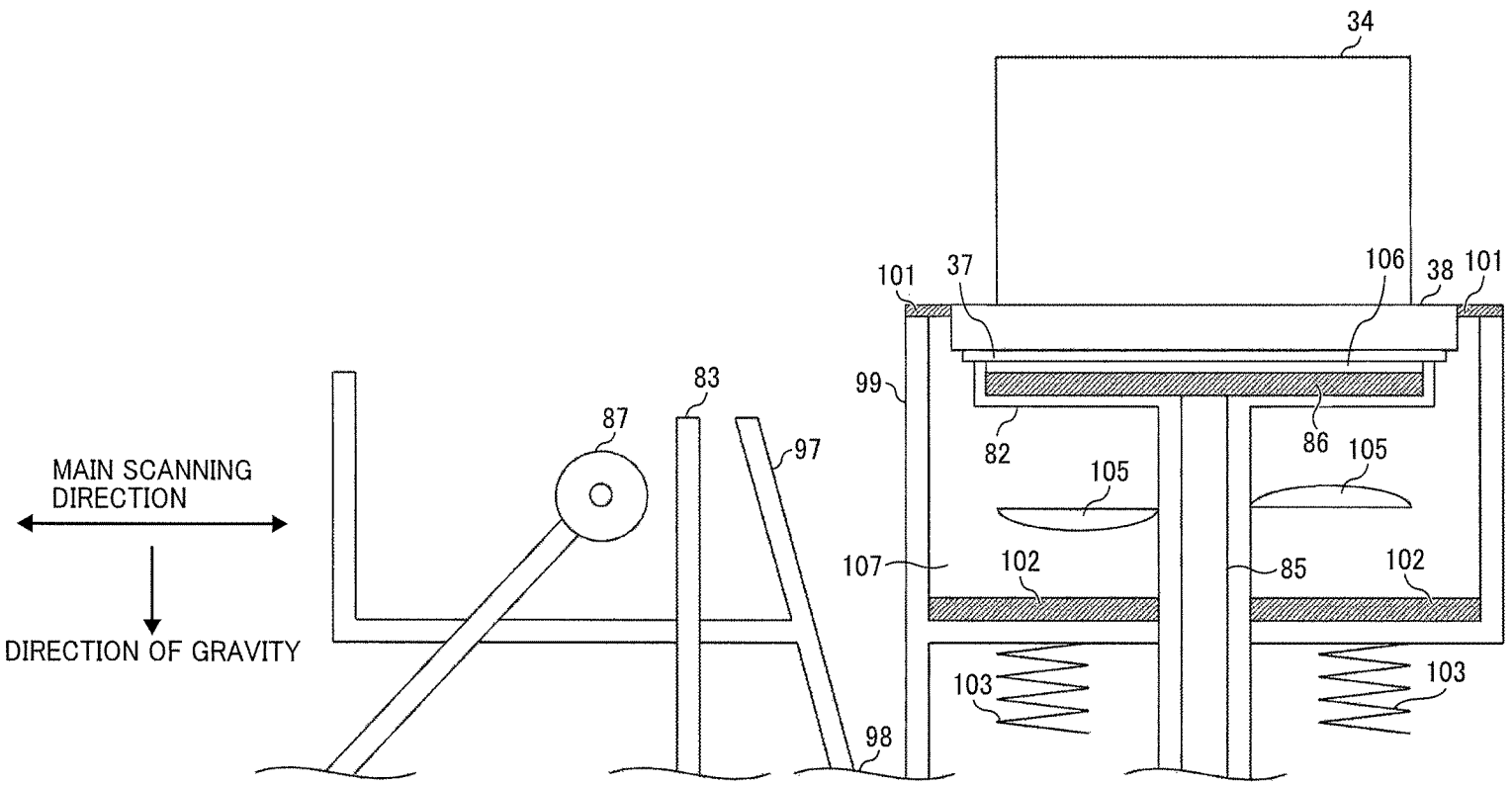
FIG. 37 is a cross-sectional view of an inkjet printer including a stirrer according to an embodiment, as viewed in the sub-scanning direction.

Further, as illustrated in FIG. 37, the inkjet printer 1 as an embodiment of this disclosure can further include a stirrer 105 (e.g., a fan or a propeller) to stir air in the head cap interior 107 to shorten the time period from when the head cap interior 107 is sealed until the head cap interior 107 is filled with steam and the relative humidity is stabilized. FIG. 37 is a cross-sectional view of the inkjet printer 1, as viewed in the sub-scanning direction.

Figure 38:
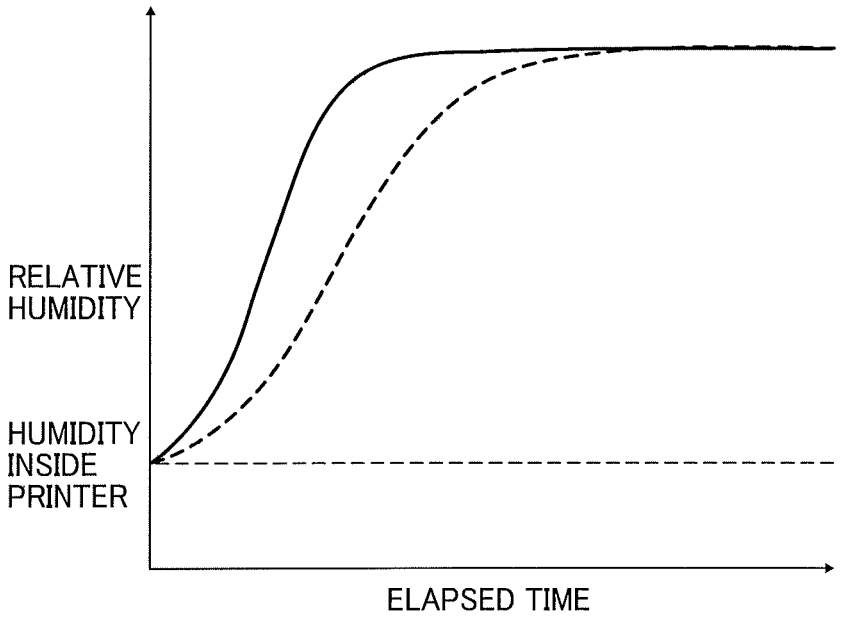
FIG. 38 illustrates a graph of relative humidity changes of the head cap interior when the liquid discharge head is capped with the head cap, in the structure illustrated in FIG. 37.

Referring to FIG. 38, descriptions are given below of changes in relative humidity of the head cap interior 107 when the stirrer 105 stirs air inside the head cap interior 107 after the head cap interior 107 is sealed. FIG. 38 illustrates graphs of changes in the relative humidity of the head cap interior 107 while the liquid discharge head 34 is capped with the head cap 99.

In FIG. 38, for comparison, the case where stirring by the stirrer 105 is not performed is also illustrated. That is, in FIG. 38, the solid graph corresponds to the case where stirring by the stirrer 105 is performed, and the dotted graph corresponds to the case where stirring by the stirrer 105 is not performed. For comparison, the graphs in FIG. 38 are on the assumption that the interior of the inkjet printer 1 is kept at a constant humidity.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A maintenance device for a liquid discharge head, the maintenance device comprising:

a first cap to seal a nozzle face of the liquid discharge head;

a second cap disposed outside the first cap, the second cap being disposed to seal the first cap and at least a contact portion between the nozzle face of the liquid discharge head and the first cap;

a humidity conditioner disposed outside the first cap and inside the second cap, the humidity conditioner to adjust humidity in a space between the first cap and the second cap; and an outside-air shutter disposed to move, when the second cap is in maintenance position, from a first position, at which the space between the first cap and the second cap is not sealed, to a closed position at which the outside-air shutter contacts the second cap and the liquid discharge head to seal the space between the first cap and the second cap.

2. The maintenance device according to claim 1, further comprising a stirrer to stir air in the space between the first cap and the second cap.

3. The maintenance device according to claim 1, further comprising a liquid remover to remove liquid adhering to the nozzle face.

4. The maintenance device according to claim 1, wherein the humidity conditioner is to generate vapor to adjust the humidity in the space between the first cap and the second cap.

5. The maintenance device according to claim 1, wherein the humidity conditioner includes a saturated salt solution of at least one of potassium sulfate, potassium chloride, sodium chloride, sodium bromide, and potassium carbonate.

6. The maintenance device according to claim 1, wherein the humidity conditioner is disposed on a side face of the second cap.

7. The maintenance device according to claim 1, wherein the humidity conditioner is disposed at a bottom of the second cap.

8. The maintenance device according to claim 1, further comprising a sealed-state retainer to seal the space inside the second cap in a state in which the second cap is disengaged from the liquid discharge head.

9. A liquid discharge device comprising:

the liquid discharge head; and the maintenance device according to claim 1, to perform maintenance of the liquid discharge head.

10. A liquid discharge apparatus comprising:

the liquid discharge head; and the maintenance device according to claim 1, to perform maintenance of the liquid discharge head.

11. A capping device for a liquid discharge head, the capping device comprising:

a first cap to seal a nozzle face of the liquid discharge head;

a second cap disposed outside the first cap, the second cap being disposed to seal the first cap and at least a contact portion between the nozzle face of the liquid discharge head and the first cap; and a humidity conditioner disposed outside the first cap and inside the second cap, to employ a saturated aqueous solution of a salt to maintain a substantially constant humidity level in a sealed space between the first cap and the second cap.

12. A liquid discharge apparatus comprising:

the liquid discharge head; and the capping device according to claim 11, to cap the liquid discharge head.

* * * * *